US008573263B2

(12) United States Patent
Bartholomew et al.

(10) Patent No.: US 8,573,263 B2
(45) Date of Patent: Nov. 5, 2013

(54) APPARATUS AND METHOD FOR CUSTOM COSMETIC DISPENSING

(75) Inventors: Julie R. Bartholomew, Birmingham, MI (US); Richard T. Jobe, Dayton, OH (US); Thomas C. Bodiker, II, Englewood, OH (US); Timothy E. O'Meara, Beavercreek, OH (US); Dave Hanselman, Miamisburg, OH (US); Jim Foley, Kettering, OH (US)

(73) Assignee: Cosmetic Technologies, LLC, West Bloomfield, MI (US)

( * ) Notice: Subject to any disclaimer, the term of this patent is extended or adjusted under 35 U.S.C. 154(b) by 22 days.

(21) Appl. No.: 13/403,581

(22) Filed: Feb. 23, 2012

(65) Prior Publication Data

US 2012/0152406 A1 Jun. 21, 2012

Related U.S. Application Data

(63) Continuation of application No. 12/341,126, filed on Dec. 22, 2008, now Pat. No. 8,141,596, which is a continuation of application No. 11/460,486, filed on Jul. 27, 2006, now Pat. No. 7,475,710, which is a continuation of application No. 10/900,044, filed on Jul. 27, 2004, now Pat. No. 7,082,970, which is a continuation of application No. 10/716,317, filed on Nov. 18, 2003, now Pat. No. 6,883,561, which is a continuation of application No. 10/246,391, filed on Sep. 18, 2002, now Pat. No. 6,672,341, which is a continuation-in-part of application No. 29/157,727, filed on Mar. 22, 2002, now Pat. No. Des. 485,310.

(60) Provisional application No. 60/357,001, filed on Feb. 14, 2002, provisional application No. 60/324,493, filed on Sep. 24, 2001, provisional application No. 60/405,126, filed on Aug. 22, 2002.

(51) Int. Cl.
*A61M 11/00* (2006.01)

(52) U.S. Cl.
USPC ..... 141/18; 141/104; 222/144

(58) Field of Classification Search
USPC ..... 141/2, 9, 18, 100–104; 222/144
See application file for complete search history.

(56) References Cited

U.S. PATENT DOCUMENTS

| | | | |
|---|---|---|---|
| 967,938 | A | 8/1910 | Krause |
| 1,912,899 | A | 6/1933 | Johannsen |
| D90,897 | S | 10/1933 | Rockola |
| D96,564 | S | 8/1935 | Simpkins |

(Continued)

FOREIGN PATENT DOCUMENTS

| | | |
|---|---|---|
| CA | 98986 | 3/2003 |
| DE | 4110299 C1 | 2/1993 |

(Continued)

OTHER PUBLICATIONS www.vinovenue.net (Jan. 19, 2005), NPR Interview Transcript regarding same.

(Continued)

*Primary Examiner* — Steven Douglas
(74) *Attorney, Agent, or Firm* — The Dobrusin Law Firm, P.C.

(57) ABSTRACT

Improved custom cosmetic formulation dispensing system including ingredients reservoirs for syringe dispensing. The ingredients reservoirs are carried by a translatable carrier to bring the respective reservoirs into dispensing alignment with a package, into which a preselected amount of the ingredient is dispensed.

20 Claims, 10 Drawing Sheets

(56) References Cited

U.S. PATENT DOCUMENTS

| | | | |
|---|---|---|---|
| 2,393,371 | A | 1/1946 | Harris |
| 2,417,677 | A | 3/1947 | Cohan |
| D192,180 | S | 2/1962 | Kodgman |
| D192,301 | S | 2/1962 | Schaef |
| 3,024,583 | A | 3/1962 | Gastright |
| 3,471,611 | A | 10/1969 | Scott et al. |
| 3,527,236 | A | 9/1970 | Anthony et al. |
| 3,598,284 | A | 8/1971 | Wessely |
| 3,688,947 | A | 9/1972 | Reichenberger |
| 3,692,027 | A | 9/1972 | Ellinwood, Jr. |
| 3,860,015 | A | 1/1975 | Tarro |
| 4,003,379 | A | 1/1977 | Ellinwood, Jr. |
| D248,693 | S | 7/1978 | Housman |
| 4,133,525 | A | 1/1979 | Balles et al. |
| 4,146,029 | A | 3/1979 | Ellinwood, Jr. |
| 4,160,271 | A | 7/1979 | Grayson et al. |
| 4,176,762 | A | 12/1979 | Scalera et al. |
| 4,271,192 | A | 6/1981 | Wurtman et al. |
| 4,281,664 | A | 8/1981 | Duggan |
| 4,299,220 | A | 11/1981 | Dorman |
| 4,351,591 | A | 9/1982 | Stockett |
| 4,434,467 | A | 2/1984 | Scott |
| 4,461,401 | A | 7/1984 | Sasnett, Jr. |
| 4,470,987 | A | 9/1984 | Wurtman et al. |
| 4,544,371 | A | 10/1985 | Dormandy, Jr. et al. |
| 4,556,063 | A | 12/1985 | Thompson et al. |
| 4,561,850 | A | 12/1985 | Fabbri et al. |
| 4,628,974 | A | 12/1986 | Meyer et al. |
| 4,651,716 | A | 3/1987 | Forester et al. |
| 4,674,518 | A | 6/1987 | Salo |
| 4,681,546 | A | 7/1987 | Hart |
| 4,686,987 | A | 8/1987 | Salo et al. |
| 4,705,083 | A | 11/1987 | Rossetti |
| 4,764,044 | A | 8/1988 | Konose |
| 4,830,218 | A | 5/1989 | Shirkhan |
| 4,838,457 | A | 6/1989 | Swahl et al. |
| 4,846,184 | A | 7/1989 | Comment et al. |
| 4,871,262 | A | 10/1989 | Krauss et al. |
| 4,887,410 | A | 12/1989 | Gandini |
| 4,897,987 | A | 2/1990 | Spalla |
| D306,808 | S | 3/1990 | Thomas |
| 4,909,632 | A | 3/1990 | Simpson |
| 4,944,299 | A | 7/1990 | Silvian |
| 4,953,985 | A | 9/1990 | Miller |
| 4,966,205 | A | 10/1990 | Tanaka |
| 4,967,938 | A | 11/1990 | Hellenberg |
| 4,987,897 | A | 1/1991 | Funke |
| 5,014,698 | A | 5/1991 | Cohen |
| 5,040,533 | A | 8/1991 | Fearnot |
| 5,041,107 | A | 8/1991 | Heil, Jr. |
| 5,042,497 | A | 8/1991 | Shapland |
| 5,042,691 | A | 8/1991 | Maldonado |
| 5,044,520 | A | 9/1991 | Moisan |
| 5,058,581 | A | 10/1991 | Silvian |
| D322,542 | S | 12/1991 | Fontlladosa |
| 5,078,302 | A | 1/1992 | Hellenberg |
| 5,083,591 | A | 1/1992 | Edwards et al. |
| 5,111,855 | A | 5/1992 | Boeck et al. |
| 5,116,134 | A | 5/1992 | Edwards et al. |
| 5,119,973 | A | 6/1992 | Miller et al. |
| D327,695 | S | 7/1992 | Edstrom |
| D327,895 | S | 7/1992 | Edstrom |
| 5,137,367 | A | 8/1992 | Madonia et al. |
| 5,163,010 | A | 11/1992 | Klein et al. |
| 5,163,484 | A | 11/1992 | Howlett et al. |
| 5,193,720 | A | 3/1993 | Mayberry |
| 5,197,802 | A | 3/1993 | Miller et al. |
| 5,203,387 | A | 4/1993 | Howlett et al. |
| 5,267,178 | A | 11/1993 | Berner |
| 5,267,669 | A | 12/1993 | Dixon et al. |
| 5,268,620 | A | 12/1993 | Hellenberger |
| 5,268,849 | A | 12/1993 | Howlett et al. |
| 5,271,527 | A | 12/1993 | Haber et al. |
| 5,271,628 | A | 12/1993 | Okada |
| 5,305,917 | A | 4/1994 | Miller et al. |
| 5,310,257 | A | 5/1994 | Altieri, Jr. et al. |
| 5,311,293 | A | 5/1994 | MacFarlane et al. |
| 5,312,240 | A | 5/1994 | Divone, Sr. et al. |
| 5,313,267 | A | 5/1994 | MacFarlane et al. |
| D347,645 | S | 6/1994 | Miller |
| D347,646 | S | 6/1994 | Mayberry |
| 5,328,057 | A | 7/1994 | Hellenberger et al. |
| D349,506 | S | 8/1994 | Caruso et al. |
| 5,356,041 | A | 10/1994 | Hellenberger et al. |
| 5,361,812 | A | 11/1994 | Arneson et al. |
| 5,368,196 | A | 11/1994 | Hellenberger et al. |
| 5,379,916 | A | 1/1995 | Martindale et al. |
| 5,397,134 | A | 3/1995 | Fishman et al. |
| D357,142 | S | 4/1995 | Jones et al. |
| 5,407,100 | A | 4/1995 | Tracy et al. |
| 5,460,297 | A | 10/1995 | Shannon et al. |
| 5,478,238 | A | 12/1995 | Gourtou et al. |
| D366,304 | S | 1/1996 | Lewis |
| 5,480,288 | A | 1/1996 | Hellenberger et al. |
| 5,495,338 | A | 2/1996 | Gouriou et al. |
| 5,507,575 | A | 4/1996 | Rossetti |
| 5,524,656 | A | 6/1996 | Konarski et al. |
| 5,531,710 | A | 7/1996 | Dang et al. |
| 5,537,211 | A | 7/1996 | Dial |
| 5,549,372 | A | 8/1996 | Lewis |
| D374,677 | S | 10/1996 | Hodson et al. |
| 5,562,109 | A | 10/1996 | Tobiason |
| 5,562,643 | A | 10/1996 | Johnson |
| 5,566,693 | A | 10/1996 | Gunderman et al. |
| 5,612,868 | A | 3/1997 | Off et al. |
| 5,622,692 | A | 4/1997 | Rigg et al. |
| 5,626,155 | A | 5/1997 | Saute |
| 5,626,260 | A | 5/1997 | Waldner |
| 5,629,981 | A | 5/1997 | Nerlikar |
| 5,632,314 | A | 5/1997 | Koppe et al. |
| 5,636,637 | A | 6/1997 | Guiolet et al. |
| 5,643,341 | A | 7/1997 | Hirsch et al. |
| 5,647,411 | A | 7/1997 | Koppe et al. |
| 5,668,633 | A | 9/1997 | Cheetam et al. |
| 5,687,322 | A | 11/1997 | Deaton et al. |
| 5,690,252 | A | 11/1997 | Oleksiewicz et al. |
| 5,692,291 | A | 12/1997 | Deevi et al. |
| 5,697,527 | A | 12/1997 | Altieri, Jr. et al. |
| 5,711,458 | A | 1/1998 | Langeveld et al. |
| 5,711,601 | A | 1/1998 | Thomas et al. |
| 5,715,314 | A | 2/1998 | Payne et al. |
| 5,716,150 | A | 2/1998 | Gueret |
| 5,717,750 | A | 2/1998 | Adams, Jr. et al. |
| 5,720,017 | A | 2/1998 | Cheetam et al. |
| 5,724,424 | A | 3/1998 | Gifford |
| 5,730,330 | A | 3/1998 | Reading |
| D393,150 | S | 4/1998 | Swanston et al. |
| 5,771,524 | A | 6/1998 | Woods et al. |
| 5,778,901 | A | 7/1998 | Abrahamian |
| 5,785,510 | A | 7/1998 | Altieri, Jr. et al. |
| 5,785,960 | A | 7/1998 | Rigg et al. |
| 5,797,750 | A | 8/1998 | Gouriou et al. |
| 5,813,420 | A | 9/1998 | Sussman |
| D401,246 | S | 11/1998 | Langeveld et al. |
| 5,841,421 | A | 11/1998 | Cheetam et al. |
| 5,842,641 | A | 12/1998 | Mazzalveri |
| 5,860,809 | A | 1/1999 | Meehan |
| 5,862,947 | A | 1/1999 | Wiegner et al. |
| 5,867,403 | A | 2/1999 | Sasnett et al. |
| 5,897,204 | A | 4/1999 | Dittmer et al. |
| 5,903,465 | A | 5/1999 | Brown |
| 5,904,421 | A | 5/1999 | Mazzalveri |
| 5,906,433 | A | 5/1999 | Mazzalveri |
| 5,924,426 | A | 7/1999 | Galazin |
| 5,931,166 | A | 8/1999 | Weber et al. |
| 5,933,792 | A | 8/1999 | Anderson et al. |
| 5,938,080 | A | 8/1999 | Haaser et al. |
| 5,944,227 | A | 8/1999 | Schroeder et al. |
| 5,945,112 | A | 8/1999 | Flynn et al. |
| 5,960,411 | A | 9/1999 | Hartman et al. |
| 5,971,351 | A | 10/1999 | Swabb |
| 5,972,322 | A | 10/1999 | Rath et al. |
| 5,982,501 | A | 11/1999 | Benz et al. |
| 5,984,146 | A | 11/1999 | Kaufman |

(56) References Cited

U.S. PATENT DOCUMENTS

| | | | |
|---|---|---|---|
| 5,992,691 | A | 11/1999 | Post et al. |
| 5,993,792 | A | 11/1999 | Rath et al. |
| 6,000,407 | A | 12/1999 | Galazin |
| 6,002,488 | A | 12/1999 | Berg et al. |
| 6,003,731 | A | 12/1999 | Post et al. |
| 6,021,362 | A | 2/2000 | Maggard et al. |
| 6,035,860 | A | 3/2000 | Mombourquette |
| 6,035,867 | A | 3/2000 | Barrick |
| 6,056,158 | A | 5/2000 | Rossetti et al. |
| 6,065,969 | A | 5/2000 | Rifkin et al. |
| 6,073,834 | A | 6/2000 | Michael et al. |
| 6,089,538 | A | 7/2000 | Shirkhan |
| 6,119,895 | A | 9/2000 | Fugere et al. |
| 6,121,878 | A | 9/2000 | Brady et al. |
| 6,139,429 | A | 10/2000 | Shoemaker, Jr. |
| 6,158,997 | A | 12/2000 | Post |
| 6,172,596 | B1 | 1/2001 | Cesar et al. |
| 6,177,093 | B1 | 1/2001 | Lombardi et al. |
| D437,151 | S | 2/2001 | Gerstmar |
| 6,182,555 | B1 | 2/2001 | Scheer et al. |
| 6,186,686 | B1 | 2/2001 | Neuner et al. |
| 6,198,536 | B1 | 3/2001 | Baker |
| 6,200,210 | B1 | 3/2001 | Pratt |
| 6,202,895 | B1 | 3/2001 | Fox |
| D442,405 | S | 5/2001 | Gerstmar |
| 6,264,786 | B1 | 7/2001 | Cromett |
| 6,270,273 | B1 | 8/2001 | Ohba |
| 6,273,298 | B1 | 8/2001 | Post |
| 6,293,284 | B1 | 9/2001 | Rigg |
| 6,297,420 | B1 | 10/2001 | Heincke |
| 6,318,596 | B1 | 11/2001 | Wiesner |
| 6,338,030 | B1 | 1/2002 | Senn et al. |
| 6,338,349 | B1 | 1/2002 | Robinson et al. |
| 6,371,129 | B1 | 4/2002 | Le Bras-Brown et al. |
| 6,382,269 | B1 | 5/2002 | Tatsuno |
| 6,383,542 | B1 | 5/2002 | Khodor et al. |
| 6,402,120 | B1 | 6/2002 | Swaab |
| 6,412,658 | B1 | 7/2002 | Bartholomew et al. |
| D461,080 | S | 8/2002 | Bartholomew et al. |
| D465,810 | S | 11/2002 | Bartholomew et al. |
| 6,510,366 | B1 | 1/2003 | Murray et al. |
| 6,516,245 | B1 | 2/2003 | Dirksing et al. |
| 6,557,369 | B1 | 5/2003 | Phelps et al. |
| 6,607,100 | B2 | 8/2003 | Phelps et al. |
| 6,615,881 | B2 | 9/2003 | Bartholomew et al. |
| 6,622,064 | B2 | 9/2003 | Bartholomew et al. |
| 6,663,818 | B2 | 12/2003 | Statham et al. |
| D485,310 | S | 1/2004 | Bartholomew et al. |
| 6,672,341 | B2 | 1/2004 | Bartholomew et al. |
| 6,779,686 | B2 | 8/2004 | Bartholomew et al. |
| 6,782,307 | B2 | 8/2004 | Wilmott et al. |
| D500,804 | S | 1/2005 | Bartholomew et al. |
| 6,883,561 | B2 | 4/2005 | Bartholomew |
| D513,040 | S | 12/2005 | Bartholomew |
| 7,082,970 | B2 | 8/2006 | Bartholomew |
| 7,099,740 | B2 | 8/2006 | Bartholomew |
| 7,121,429 | B2 | 10/2006 | Bartholomew |
| 7,134,573 | B2 | 11/2006 | Post |
| 7,174,310 | B2 | 2/2007 | Bartholomew et al. |
| 2001/0000802 | A1 | 5/2001 | Soykan et al. |
| 2001/0044579 | A1 | 11/2001 | Pratt |
| 2002/0026228 | A1 | 2/2002 | Schauerte |
| 2002/0109270 | A1 | 8/2002 | Swaab |
| 2002/0131985 | A1 | 9/2002 | Shana'a et al. |
| 2002/0136700 | A1 | 9/2002 | Margosiak et al. |
| 2003/0014324 | A1 | 1/2003 | Donovan et al. |
| 2003/0060854 | A1 | 3/2003 | Zhu |
| 2003/0062379 | A1 | 4/2003 | Bartholomew et al. |
| 2003/0098314 | A1 | 5/2003 | Phelps et al. |
| 2003/0151611 | A1 | 8/2003 | Turpin et al. |
| 2004/0002739 | A1 | 1/2004 | Cates et al. |
| 2004/0004309 | A1 | 1/2004 | Sears |
| 2004/0122553 | A1 | 6/2004 | Phan et al. |
| 2004/0243361 | A1 | 12/2004 | Steuben et al. |
| 2006/0024342 | A1 | 2/2006 | Bartholomew |
| 2006/0043111 | A1 | 3/2006 | Jennings et al. |
| 2006/0124196 | A1 | 6/2006 | Bartholomew |
| 2006/0283521 | A1 | 12/2006 | Bartholomew |
| 2007/0194038 | A1 | 8/2007 | Bartholomew |
| 2008/0047972 | A1 | 2/2008 | Bartholomew |

FOREIGN PATENT DOCUMENTS

| | | | |
|---|---|---|---|
| DE | 40202765.5 | | 3/2002 |
| EP | 0443741 | B1 | 8/1991 |
| EP | 0446512 | B1 | 1/1995 |
| EP | 0682236 | B1 | 11/1995 |
| EP | 0686997 | A2 | 12/1995 |
| EP | 0871022 | | 10/1998 |
| EP | 1093842 | | 4/2001 |
| EP | 3002418 | | 2/2003 |
| EP | 1429640 | | 3/2007 |
| FR | 021986 | | 3/2002 |
| GB | 3002418 | | 3/2002 |
| GB | 2431577 | | 5/2007 |
| GR | 3062096 | | 6/2007 |
| JP | 04-231006 | | 8/1992 |
| JP | 05-025020 | | 2/1993 |
| JP | 05-107115 | | 4/1993 |
| JP | 05-233651 | | 9/1993 |
| JP | 07-243908 | | 9/1995 |
| JP | 07-270396 | | 10/1995 |
| JP | 08-050125 | | 2/1996 |
| JP | 08-280633 | | 10/1996 |
| JP | 09-10033 | | 1/1997 |
| JP | 09-038045 | | 2/1997 |
| JP | 09-133584 | | 5/1997 |
| JP | 09-178560 | | 7/1997 |
| JP | 10-339670 | | 12/1998 |
| JP | 11-169231 | | 6/1999 |
| JP | 11-218447 | | 8/1999 |
| JP | 11-265443 | | 9/1999 |
| JP | 2001-126140 | | 5/2001 |
| JP | 1166435 | | 1/2003 |
| SU | 1704759 | | 1/1992 |
| WO | 95/05892 | | 3/1995 |
| WO | 98/05417 | | 2/1998 |
| WO | 98/30189 | | 7/1998 |
| WO | 99/34904 | | 7/1999 |
| WO | 99/61234 | | 12/1999 |
| WO | 00/64570 | | 11/2000 |
| WO | 01/12239 | | 2/2001 |
| WO | 01/09777 | | 3/2001 |
| WO | 01/91601 | | 6/2001 |
| WO | 01/75586 | | 10/2001 |
| WO | 01/91600 | | 12/2001 |
| WO | 02/05200 | | 1/2002 |
| WO | 03/026458 | | 4/2003 |
| WO | 06/020189 | | 2/2006 |
| WO | 06/052863 | | 5/2006 |

OTHER PUBLICATIONS

EP Office Action for Serial No. 01 922 731.3-2307, Applicant IMX Labs, Inc. dated Jun. 17, 2005.

EP Office Action for Serial No. 02 763 648.9-2313, Applicant IMX Labs, Inc. dated Jun. 6, 2005.

Partial International Search PCT/US2005/025384 dated Nov. 16, 2005.

International Search PCT/US2005/040240 dated Apr. 3, 2006.

Website at www.reflect.com, Jan. 25, 2002.

Website at www.threecustom.com, Jan. 25, 2002.

Website at www.colorlab-cosmetics.com, Jan. 25, 2002.

Pamphlet of Jovan, "Express your individuality," Feb. 17, 2000.

Website at www.immedia.it—Coty Introduces Jovan Individuality pp. 1-3 (accessed Jun. 8, 2001).

Website at www.cpcpkg.com, Feb. 17, 2003.

Website at www.fast-fluid.com—"TiNTiA (hair dye dispenser" p. 2 (accessed May 18, 2004).

Information from www.cosmetics.com/custblnd.htm, Oct. 11, 2000.

Evans, "An introduction to Color," John Wiley & Sons, Inc., New York, 1948, pp. 87-90.

(56) References Cited

OTHER PUBLICATIONS

Wyszecki et al., "Color Science; Concepts and Methods, Quantitative Data and Formulae," 2nd edition, A. Wiley Interscience Publication, p. 63, no date.

Cheskin, L. "Color Guide for Marketing Media," The MacMillan Co., 1954, pp. 133-140.

Lovett, P.A., et al., "measurement of the Skin Colour of Babies in Hospital," National Lighting Conference 1986, pp. 140-154.

"The Shades of You; Your Color Palette," "Your new Image Through Color & Line," California Fashion Image, Crown Summit Books, 1981, pp. 1-3, 17, 21-29, 97-105, 111, 112, 120-127.

Shibatani, J et al., "Measurements of Aging Effects of Facial Color Distribution and Applications," J Soc. Cosmet. Chem, Japan, vol. 19, No. 1, 1985, pp. 48-52.

Search Report dated May 23, 2003.

Supplementary European Search Report dated Apr. 6, 2004.

Website at www.indexcorp.com/groups/fluidmgt.asp—"Fluid Management" pp. 1-2 (accessed May 18, 2004).

European Search Report dated Nov. 11, 2008 (EP 08003990.2).

US 6,568,560, 05/2003, Bartholomew (withdrawn)

APPARATUS AND METHOD FOR CUSTOM COSMETIC DISPENSING

CLAIM OF PRIORITY

This application is a continuation of copending application Ser. No. 12/341,126, filed on Dec. 22, 2008, which is a continuation of application Ser. No. 11/460,486, filed on Jul. 27, 2006 (now U.S. Pat. No. 7,475,710), which is a continuation of application Ser. No. 10/900,044 filed on Jul. 27, 2004 (now U.S. Pat. No. 7,082,970); which is a continuation of application Ser. No. 10/716,317 filed on Nov. 18, 2003 (now U.S. Pat. No. 6,883,561); which is a continuation of application Ser. No. 10/246,391 filed on Sep. 18, 2002 (now U.S. Pat. No. 6,672,341); which is a continuation-in-part of application number 29/157,727 filed on Mar. 22, 2002 (now U.S. Design Pat. No. D485,310). application Ser. No. 10/246,391 filed on Sep. 18, 2002 (now U.S. Pat. No. 6,672,341), claims the benefit of U.S. Provisional Application Nos. 60/324,493, filed Sep. 24, 2001; 60/357,001, filed Feb. 14, 2002, and 60/405,126, filed Aug. 22, 2002, the Provisional Applications are hereby incorporated by reference for all purposes.

FIELD OF THE INVENTION

The present invention relates to cosmetic dispensing and more particularly is to point of sale dispensing of custom cosmetic formulations such as nail polish or lip gloss.

BACKGROUND OF THE INVENTION

The present invention is an improvement to subject matter of previous commonly-owned applications NAIL COLOR POLISH SELECTION SYSTEM AND METHOD (Continuation of Ser. No. 09/818,389 (filed Mar. 27, 2001)), and NAIL COLOR POLISH SELECTION SYSTEM AND METHOD (Ser. No. 09/872,929 (filed Jun. 1, 2001)), which are hereby expressly incorporated by reference herein. The present invention may be employed in accordance with the teachings of U.S. Pat. No. 6,412,658, which issued on Jul. 2, 2002, the contents of which are also incorporated by reference herein.

As addressed in the above applications and patent, historically the cosmetics industry has afforded consumers a broad variety of choices for colors (including tones, shades or hues) and effects. In the typical scenario, these products are prepackaged according to a predetermined fixed amount of different colors or effects. The products are then ordinarily displayed to reveal a spectrum of a fixed number of colors. However, because of manufacturing and other practical limitations, point of sale displays only afford a finite number of selections for the consumer. Consequently, the consumers choice of color will be limited by present availability or supply of a particular color choice, and also particularly by the specific colors chosen for sale in advance by the manufacturer. The consumer is afforded no practical opportunity to custom blend a color selection.

In recent years, it has also become popular to modify the ultimate visual appearance of a manicure by the addition of effects over some or all of a nail, such as a metallic effect, sparkles, shapes (e.g., hearts, stars, etc.), texture or the like. Frequently, these must be purchased and applied separately from an to underlying base coat. Once again, the consumer is faced with a finite selection and will be limited in choice by availability at the point of sale.

In view of the foregoing, a need has developed for a custom cosmetic color selection system, pursuant to which a consumer or other customer (such as an intermediate retailer or wholesaler) can interact with the supplier to select a specific color, effect or both, to blend the resulting cosmetic product at or near the time of selection (e.g. on site at a point of sale location, or remotely such as by mail order, phone order or internet purchase).

The dispensing of certain ingredients for custom cosmetic formulations is known to pose challenges. For example, nitrocellulose-based nail polish ingredients (e.g., as might be employed in the practice of the present invention) are commonly prone to clogging small orifices. There is thus a need for an efficient apparatus for dispensing a cosmetic ingredient that will minimize the potential for clogging. There is also a need for an apparatus in which a plurality of the operation steps are automated, to minimize technician operation. There is also a need for an apparatus that permits for ease of supply and replenishment of formulation ingredients.

SUMMARY OF THE INVENTION

The present invention provides a particular solution for the dispensing of a custom formulated product (e.g., a liquid cosmetic, such as a nail polish or lip gloss) from multiple containers, such as individual containers for housing ingredients of the resulting formulation. The product is closely controlled during dispensing into a receptacle or package, and can optionally be heated, rotated, stirred or otherwise mixed (constantly or intermittently) to keep the solids (glitter, tints) in suspension before, during or after dispensing. Ingredients can be provided in ingredients containers that can be filled external of the apparatus to reduce the potential for spillage of ingredients on the apparatus. The dispensing is generally clog-free and dispensing tip blockage is substantially avoided. It may also be automated in order to reduce technician involvement.

In a particularly preferred embodiment, the apparatus of the present invention comprises:

a) an ingredient carrier that is mounted for translation about at least one axis (e.g. rotational, horizontal, vertical or otherwise);
b) a plurality of containers each filled with a different ingredient for a custom cosmetic formulation, and each being mounted to the ingredient carrier;
c) an actuator for dispensing the ingredients from the containers;
d) a holder for receiving and holding (e.g. on a rest surface, by gripping, or otherwise) a package into which the custom cosmetic is to be dispensed; and
e) an optional housing for substantially enclosing the plurality of containers and the ingredient carrier, and being configured to permit viewing by a retail customer of a dispensing step performed by the machine at the retail point of sale.

The present invention also provides an improved method, pursuant to which the above apparatus is operated for dispensing a cosmetic (e.g., a nail polish, lip gloss, body powder or other substance). In a more preferred embodiment, the present invention also provides a method of custom formulation of a liquid cosmetic, comprising the steps of:

a) providing, at a retail point of sale, a dispensing apparatus including a plurality of syringe dispensers containing different liquid cosmetic ingredients and being translatably (and optionally radially) disposed about an axis for dispensing ingredients of a custom cosmetic formulation;
b) actuating one or more of said syringes for dispensing said first cosmetic formulation into a first package; and c) actuating one or more of said syringes for dispensing a second custom cosmetic formulation into a second package.

DESCRIPTION OF THE INVENTION

Figure 1:
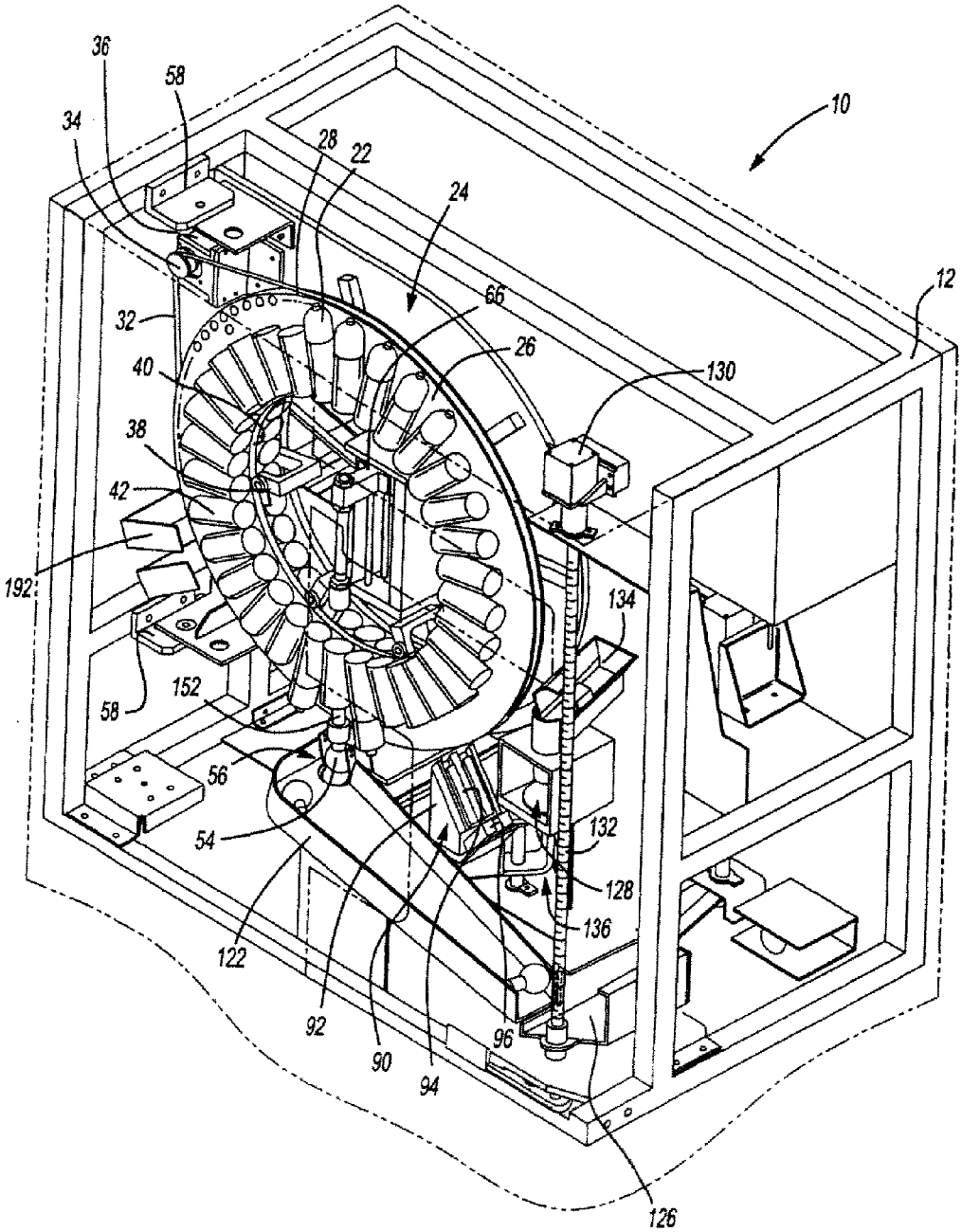
FIG. 1 is a perspective view of an apparatus in accordance with the present invention.

The present invention provides a particular solution for the dispensing of a custom formulated product (e.g., a liquid cosmetic, such as a nail polish or lip gloss) from multiple containers, such as individual containers for housing ingredients of the resulting formulation. The product is closely controlled during dispensing into a receptacle or package, and can optionally be heated, rotated, stirred or otherwise mixed (constantly or intermittently) to keep the solids (including, for example, glitter, tints, or the like) in suspension before, during or after dispensing. With reference to FIG. 1, the dispensing apparatus 10 of the present invention includes a custom cosmetic formulation (e.g., for lip gloss, nail polish, body powder or otherwise) dispenser that contains a plurality of different ingredients, such as shades, tints or hues of colors or pigments, which can be dispensed in preselected proportions to create a custom color selection. The apparatus may be carried by a frame 12 or optionally enclosed, or partially enclosed by panels 14 as in FIG. 1*a* that are opaque, transparent or at least partially transparent or including cutouts or windows. Suitable venting, filters (e.g. a charcoal filter), scrubbers or a fume extractor may also be employed.

Figure 1A:
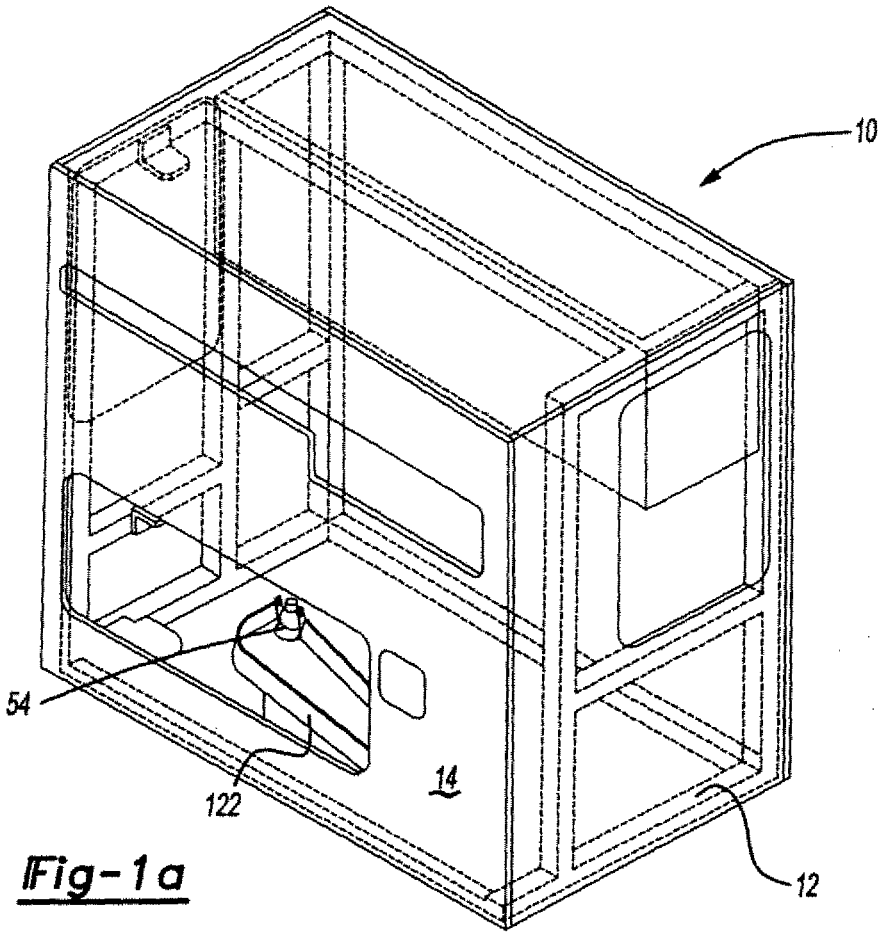
FIG. 1*a* is a perspective view of an apparatus in accordance with the is present invention with optional enclosure panels.
Figure 1B:
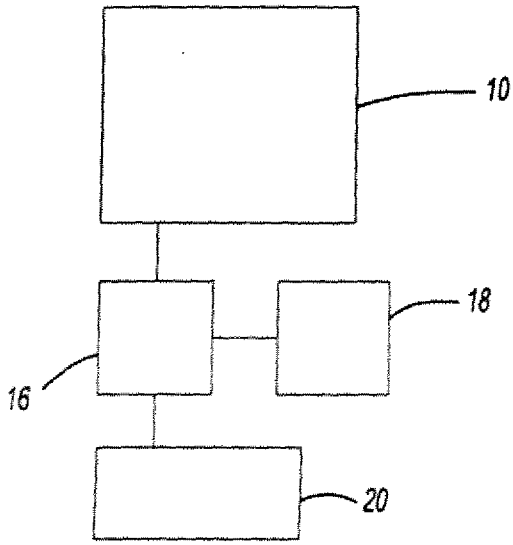
FIG. 1*b* is a schematic of a system of the present invention.

Preferably, as depicted schematically in FIG. 1*b*, an interactive computer system 16 is in controlling communication with the dispenser, although the dispenser may be operated manually. Optionally, a spectrophotometer 18, user interface 20 (e.g., touch screen, display, monitor, keyboard or other peripheral equipment), or both, is associated with the system for analyzing color, and interfacing with the computer. By way of example, color may be measured with a suitable spectrophotometer (not shown), e.g., using a GretagMacbeth 'Spectrolino' unit and associated software. Color formulation may be generated using suitable software, such as the GretagMacbeth 'ProPalette' software.

Use of such hardware and the computer allows the customer to custom choose a color and/or effect, information about which will be communicated to the dispenser, which then dispenses the appropriate proportions of the ingredients pursuant to information about the color choice stored in a data base or otherwise programmed. In another embodiment, the system includes a remote communications system, whereby a user can communicate, such as via the Internet, with the computer controlling the nail polish dispensing system and select and purchase a custom nail polish for custom dispensing and delivery to the user. Additional understanding of this system can be gleaned from the teachings of commonly-owned applications NAIL COLOR POLISH SELECTION SYSTEM AND METHOD (Continuation of Ser. No. 09/818, 389 (filed Mar. 27, 2001)), and NAIL COLOR POLISH SELECTION SYSTEM AND METHOD (Ser. No. 09/872, 929 (filed Jun. 1, 2001)), which are hereby expressly incorporated by reference herein. In addition, an overview of a proposed approach to the software of the present invention is described later in this description.

Referring to FIGS. 1-3, FIGS. 7*a*-7*c*, and FIG. 13, the present apparatus dispenses product, and particularly ingredients for a custom cosmetic formulation, from a plurality of ingredients reservoirs or containers 22 (shown as 22' in FIGS. 7*b* and 22" in FIGS. 7*c* and 13), which are present in any suitable number (e.g., greater than about 10, and more preferably 24 or more containers). Though two or more containers may contain the same ingredient (whether at the same or a different concentration), in a preferred embodiment, each of a plurality of the containers contains a different ingredient. The containers are preferably part of a syringe dispensing unit. The size of the respective barrels of the containers may vary, but in one embodiment they have a volume of about 4 to about 32 ounces or larger (or about 0.1 to about 1 liter), and are about 1 to about 16 inches long and about 1 to about 6 inches (about 2 to about 15 cm) in diameter. One preferred configuration for a minimum of about 8 to about 12 ounce (or about 0.2 to about 0.3 liter) volume is approximately 3" to about 6" long (about 7 to about 15 cm), and about 0.75" to about 2.25" (about 2 to about 6 cm) in diameter; in another embodiment, the preferred configuration is about 0.5 to about 0.8 this size.

Each of the containers 22 is mounted on a translatable (e.g., rotatable) carrier structure 24, such as a centrifuge, carousel or a Ferris wheel design that preferably allows, if desired, for continuous or intermittent rotation of the product to help keep the product solids in suspension. A highly preferred wheel is a carousel structure in which a wheel 26 having an outer periphery 28 and centrally disposed opening 30 is provided. It is possible that alternative structures be employed instead of or in addition to the above-described wheel. For example, the wheel can have a closed central portion. It may have a closed hub with spokes connecting the hub to the periphery. It may include a hub with a plurality of radial spokes, each one adapted for holding an ingredients container. It is also possible that the rotatable structure is substituted with a conveyor type apparatus, in which ingredients containers are mounted to a conveying web, such as to the web itself, or to a shelf or other platform associated with or carried by the web.

A preferred translatable carrier structure in accordance with the teachings herein will be driven by at least one electric motor, and more preferably by at least one stepper motor. A suitable drive train is employed for connecting the motor and the translatable carrier. For example, as seen in FIG. 1, the drive train includes a belt 32, that rides about the outer periphery 28 of the wheel (e.g., in a peripheral channel of the wheel), and also a fly wheel or pulley 34. In this manner, a motor 36 can be housed in an offset position relative to the axis of rotation. Of course, other motor positions and drive trains may be employed. For example the motor may be mounted with a drive shaft that has its longitudinal axis in the axis of rotation and the drive shaft drives the wheel. The motor may be mounted so that it drives a belt on a fly wheel that is disposed forward of or behind the wheel. To help stabilize the wheel it may be desirable to include a plurality of rollers 38 for running on an inner edge 40 of the wheel.

Any drive motor that is employed preferably will be signally controlled by a suitable controller or other processor, such as that in the computer 16 associated with the device. For example, the computer will be programmed with, and have an associated data base for execution thereof, formulations that specify the relative proportions of ingredients to be included in a particular cosmetic formulation that is selected by an operator (e.g., at a retail point of sale). The respective ingredients will be positioned at known locations about the wheel, and upon instruction from the computer, can be brought into dispensing position relative to a container into which it is to be dispensed. That is, based upon the predetermined location of the ingredient, the computer will direct the motor to drive the wheel to properly align the ingredients container in preparation for dispensing therefrom.

Figure 8:
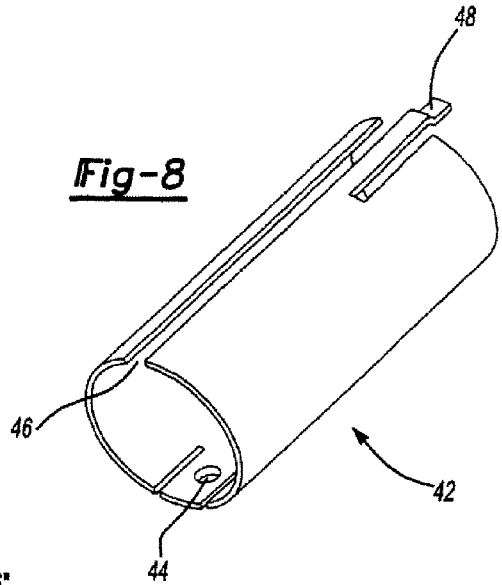
FIG. 8 is a perspective view of a mounting bracket for receiving a syringe barrel as in FIG. 7*a* in accordance with the present invention.

In order to accomplish the above, in a preferred structure, the containers 22 are positioned generally about the wheel, and are each held in place, for example, by a container holder 42. The container holder 42 may be any suitable structure for allowing removal and replacement of containers. For example, as seen in FIG. 8, the holder 42 might be prepared having one or both of its ends opened. Optionally, the shape is generally conformable with the outer surface of the containers 22 for a mating type fit. Preferably the holder may be fastened to the structure 24, such as by use of a fastener through one or more apertures 44 (see FIG. 8). It may be attached in other suitable manners as well, such as by welding, adhesive, snap fit, or other mechanical interlock. The holder may be suitably configured for allowing its overall diameter to expand or contract to help clamp or otherwise secure any containers 22 in place. For example, a buckle or strap may be employed. As shown in FIG. 8, a longitudinal slit 46 may be formed in a spring steel holder, and the elasticity of the holder material is thus used for securing containers in place. The holder may also include a flange or other projection 48 to help serve as a detent or otherwise help prevent pull through of a container, and possibly also to provide an additional local elastic portion.

The translatable carrier 24 may be adapted for rotation about a vertical axis (e.g., for a rotational plane that is generally horizontal), a horizontal axis (e.g., for a rotational plane that is generally vertical,), or an axis angled relative to a vertical or horizontal axis. It is shown in FIG. 1, for example, as rotatable about a horizontal axis. It may be manually driven, motor driven, or otherwise automated, and optionally in signaling communication with a computer (not shown) for commanding the relative motion for dispensing ingredients according to a predetermined formulation. It will be appreciated that the translatable carrier structure can be operated so that it is substantially continuously in motion to thereby provide substantially continuous mixing. It may also be operated for periodic motion.

Figure 12:
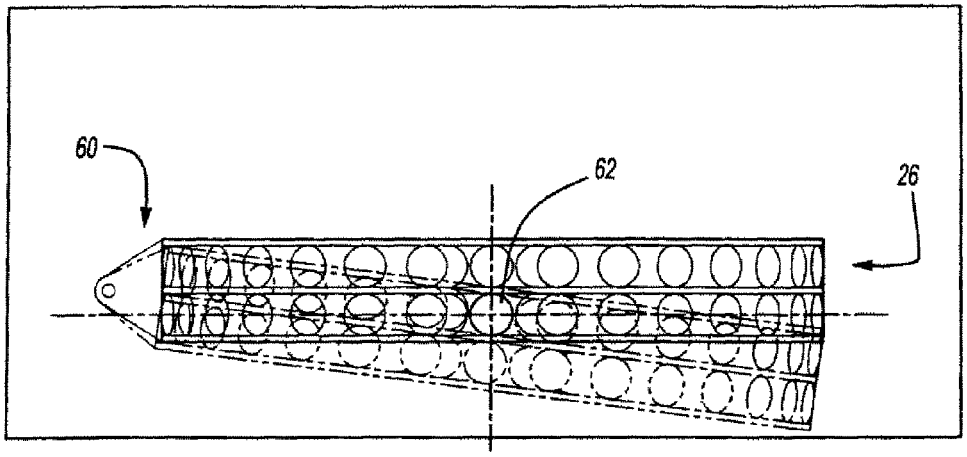
FIG. 12 is a top view illustrating the pivotal action of an illustrative wheel assembly in accordance with the present invention.

In one embodiment, ingredients containers are positioned on only one side of the wheel. In another embodiment, as seen for example in FIG. 2, ingredients containers 22 are positioned about a first side 50 of the wheel 26, and containers 22 may also be positioned about a second side 52 of the wheel. In this latter embodiment, it will be appreciated that it may be necessary to align the desired ingredients container with any package 54 into which dispensing is to occur, e.g., at a dispensing site 56 as shown in FIGS. 1, 1*a*, 3 and 5. To do this for the embodiment shown (for example) in FIGS. 1-3, the wheel 26 is pivoted about a generally vertical axis. More particularly, one or more hinges 58 or other pivot is provided (e.g. at an end portion 60) of any assembly for carrying the wheel to permit the wheel to be moved fore and aft, such as illustrated in FIG. 12, for proper desired positioning over a target site 62, such as the dispensing site 56.

Figure 2:
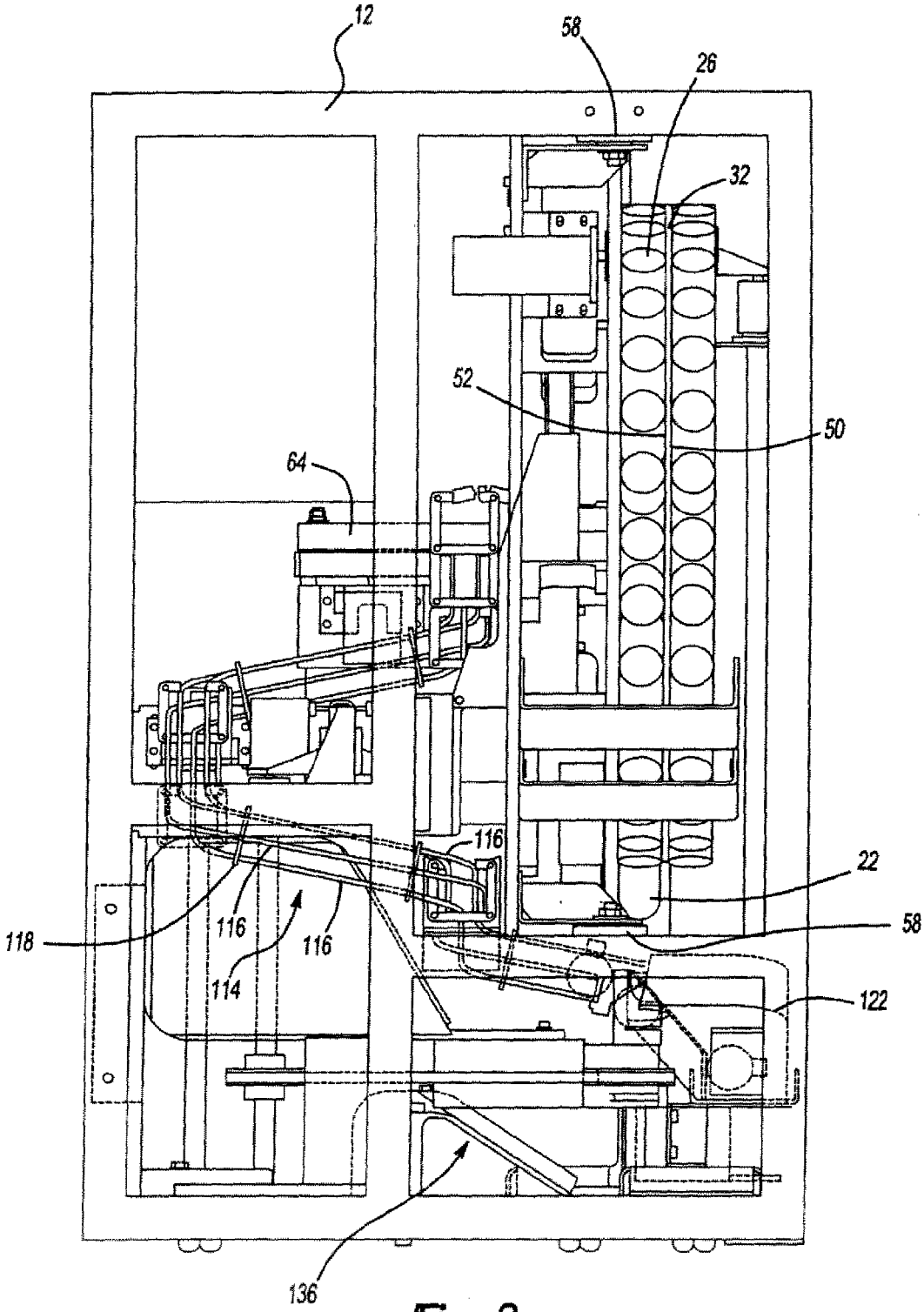
FIG. 2 is a side view of the apparatus of FIG. 1.

Any suitable drive device or mechanism may be employed to move the wheel for alignment, such as by pivotally driving it about an axis as described in the preceding paragraph. For example, a handle, grip, knob or other like device may be attached to the wheel or otherwise provided for manual pivoting. A motor driven system may also be used. Illustrated in FIG. 2 is one suitable motor driven system in which a motor drives an actuating arm associated with the wheel. One preferred structure includes a bell crank 64 (see FIG. 2) that is linked to the wheel and is driven by a motor. Other suitable drive systems may also be employed as desired (e.g. a shaft, a camming device, a spring biased member or the like) and the above is not intended to be limiting of the present invention.

As taught in the above, the translatable carrier structure 24 will be controlled so that the ingredients containers can be positioned at a desired dispensing site 56 (e.g., the general location of the receptacle) as required. A subsequent step in the process of dispensing a custom formulation involves the expulsion of contents from the ingredients containers; that is, the dispensing of the ingredients. To achieve this, one or a plurality of suitable dispensing actuators is employed. It should be recognized that the present invention advantageously permits for the use of any of a number of different types of dispensing mechanisms, such as pumps, screw drives, syringe dispensers, or other art-disclosed dispensers. A particularly preferred dispensing mechanism is a syringe dispenser, which preferably includes a barrel that functions as a reservoir for holding ingredients, an opening (e.g. a nozzle) through which ingredients are is expelled and a plunger for displacement within the barrel to change the volume within the barrel. The plunger is preferably driven by an actuator, which may be attached to the plunger or maintained separately from the plunger, but brought into driving relationship with the plunger.

Figure 3:
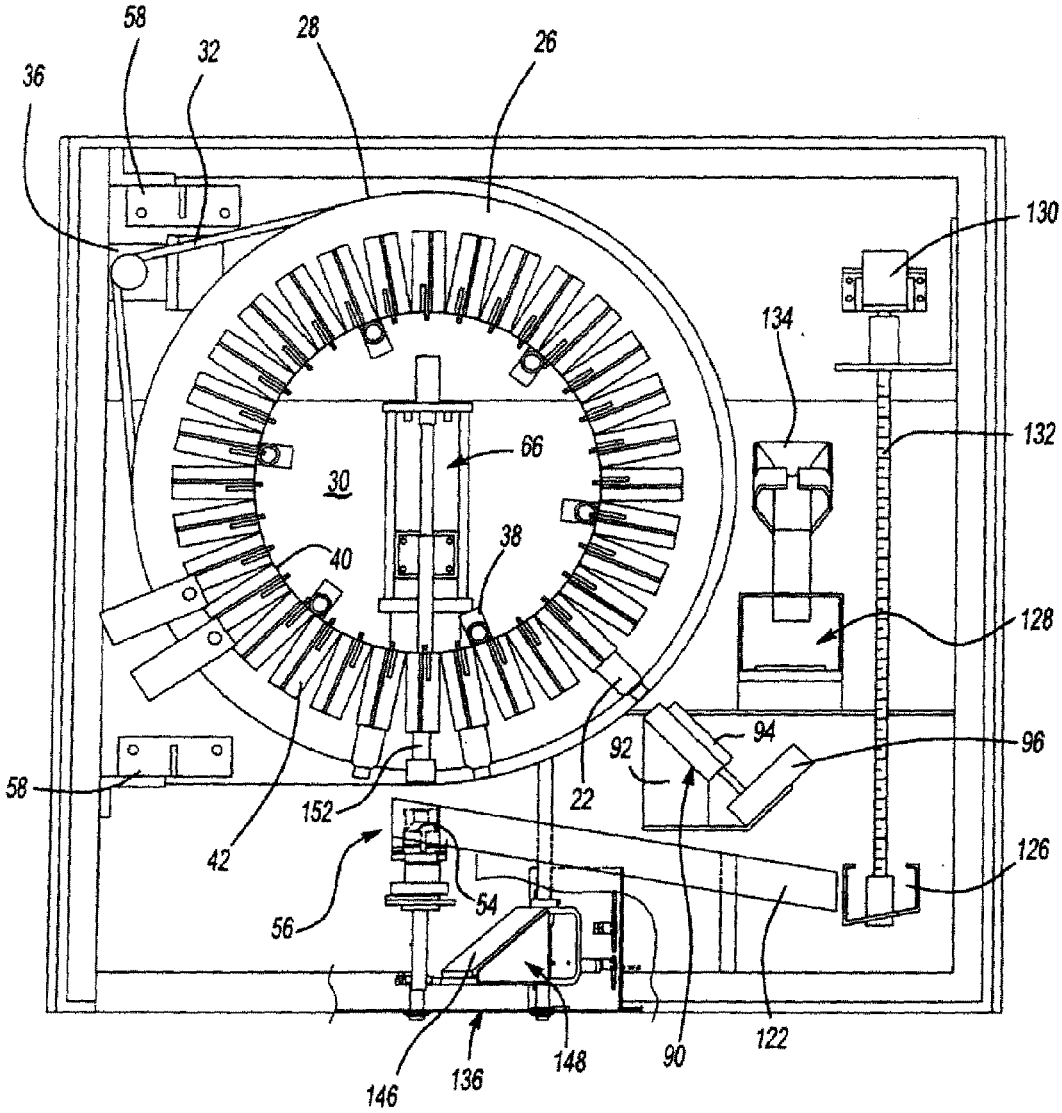
FIG. 3 is a front view of the apparatus of FIG. 1.
Figures 6, 7A:
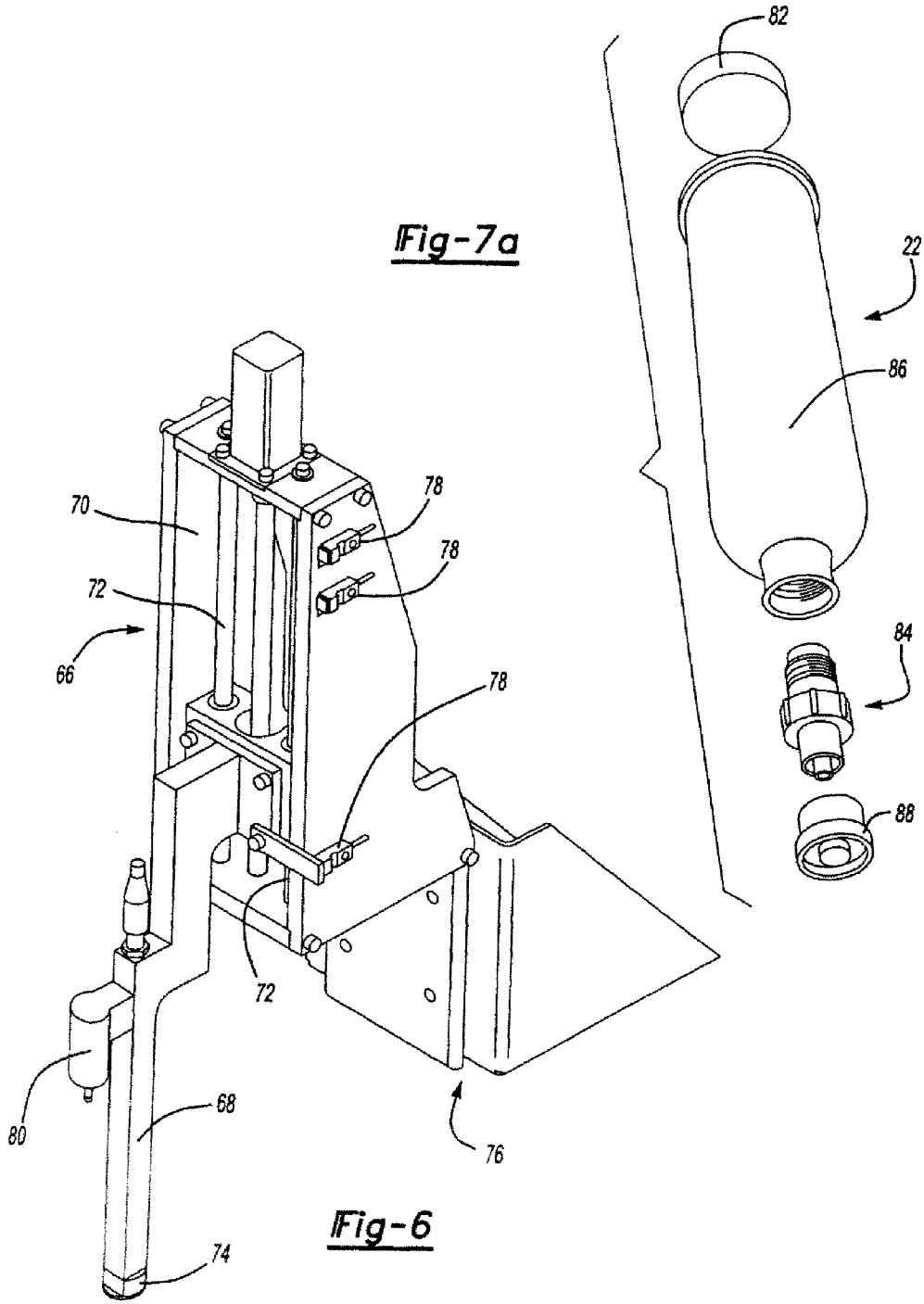
FIG. 6 is a perspective view of one type of dispensing actuator in accordance with the present invention.
FIG. 7*a* is an exploded perspective view of a syringe assembly useful in the present invention.

For the present preferred embodiment, as depicted in FIGS. 1, 3 and 6, there is employed an actuator 66 that may include a plunger or may be maintained separately from the plunger. More preferably, the actuator is a semi-permanent or permanent fixture or component of the apparatus of the present invention. The actuator 66 is any suitable device having an actuating mechanism (e.g., a gas, fluid, mechanical, manually depressable mechanism or otherwise) that will be mounted adjacent to the ingredients containers, such as generally in the central area of the rotatable structure. Preferably, the actuator is operable for depressing a plunger within the container 22 when the container is in the proper position, e.g., aligned over a package (i.e., a receptacle).

As seen in greater detail in FIG. 6, one preferred actuator 66 includes a push rod 68 that is slidingly mounted in a mounting fixture 70 (e.g., along guide posts 72) and has a free end 74, or another corresponding structure, for depressing a plunger within at least one of the syringe barrels. A suitable bracket assembly 76 may be employed for securing the actuator 66 within the apparatus 10. A particularly preferred actuator is motor driven, and (as with other motors employed herein) is preferably in signaling communication with the computer 16, from which it receives instructions as to the amount of plunger depression that is necessary to expel from an ingredients container a predefined volume of the respective ingredient. The actuation amount may be controlled in any suitable manner. For example, one or a plurality of suitable actuator position sensors 78 may be employed for sensing relative position of the push rod 68, and providing feedback to the computer for stopping or advancing actuation. Alternatively, such position feedback or otherwise could be supplied directly from a motor or actuator that is actuating the push rod. Such feedback may be referred to as "true or motor feedback". Additionally, an optional projecting arm 80 may also be employed, such as for aiding in ejecting a package from the dispensing site upon conclusion of dispensing. For example any package holder might be actuated to bring a filled package into contact with the arm 80 to torque the package loose or to otherwise help eject the package from the holder.

The actuator 66 can be pivotally mounted to the rotatable structure 24, mounted to a structure about which the rotatable structure rotates, fixed in a constant position, or itself be translatable. Optionally, each ingredients container 22 has its own independent actuator.

As seen from FIG. 7*a*, each ingredients container 22 will have a plunger 82 and a dispensing tip 84 or other suitable nozzle. A preferred tip is one such as an art-disclosed leer tip (e.g., available commercially under the designation Sem-Luer™ (part No. 231871)). The tip may be press fit into a barrel 86, integrally formed therein, threadingly attached (as shown in FIG. 7*a*), or otherwise attached. Ingredients may also be dispensed through an art-disclosed 'duckbill' valve or another suitable valve associated with each dispensing tip or nozzle, e.g. a one way check valve, ball valve, umbrella valve, flapper valve, or any other one-way valve of the many kinds well known to those skilled in the art that will seal the reservoir to prevent evaporation and emission when product is not being dispensed. Optionally a single one way valve is employed into or through which at least some or all of the syringes will dispense their respective contents. A cap 88 is preferably employed, but may be omitted if desired for a particular application. A description of examples of suitable ingredients containers, such as for use with a cap, is also provided in U.S. Pat. No. 5,531,710, hereby incorporated by reference.

It is also possible that adaptations may be made for dispensing into a package at different depths within the package or from different heights relative to the bottom of the package. For example, different ingredients containers may have syringe needles or other nozzles of different length relative to each other.

Referring again to FIGS. 1 and 3, for embodiments in which it is contemplated that a cap will be used for the ingredients containers the present invention preferably also employs a capper mechanism 90 for the ingredients containers, which is adapted for removing a cap, re-applying a cap or both. The capper mechanism location and the geometry is not critical. However, in one preferred embodiment, as shown in FIG. 1, it includes a base 92 for carrying a retractable cap holder 94. The cap holder 94 may include a suitable gripping structure such as spaced fingers or undercuts to define slots for receiving the cap and holding it in place. It may alternatively include an opening in an elastic member such as a seal or a duckbill valve tip, or yet employ suitable jaws or other grippers for encircling the cap and holding the cap, or another suitable structure. In one embodiment, a motor 96 preferably translates the holder 94 along the base, for example, along an inclined surface (as shown in FIG. 1).

Thus, in operation, a capped ingredients container will be brought into alignment with the capper mechanism 90 and the cap holder 94 will be advanced for the fingers, undercuts or like structure to engage the cap of the container. Upon engagement, the cap is removed by retraction of the cap holder 94, by rotation of the wheel, or both. After dispensing, the uncapped ingredients container is realigned with the capper and the cap advanced for capping. Cap removal may also be undertaken using other techniques, such as using a step of rotating to remove a twist off cap.

Figure 7B:
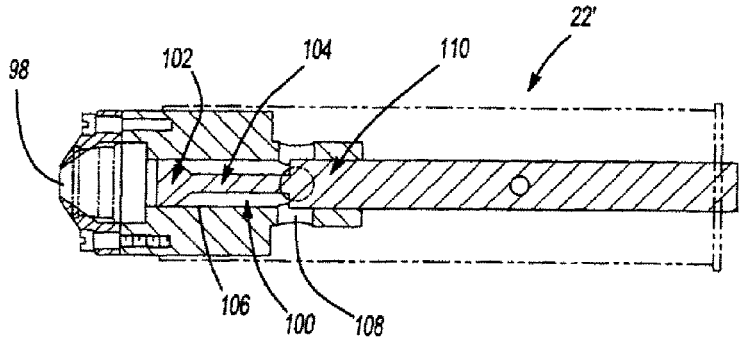
FIG. 7*b* is a side sectional view of another barrel assembly useful in the present invention.

It may be desirable for certain ingredients (e.g., a particulated material, such as a powder, a sparkle effect material such as glitter, a viscous fluid, or some other material) to use a modified ingredients container design such as is shown in FIG. 7*b*. In that design, a funnel 98 is provided at (e.g., formed in) the end of a container 22', through which ingredients are expelled. The system may include its own plunger mechanism 100 including an enlarged forward portion 102 and a thinner portion 104. Preferably the plunger mechanism is adapted to provide a metered amount of the ingredient, such as by permitting access to the region defined between a peripheral wall 106 and the thinner portion 104, through one or more ports 108 when the plunger is in a retracted position, but sealing the funnel access (e.g., by way of a rearward enlarged portion 110 of the plunger) when the plunger is depressed. When depressed, the forward enlarged portion 102 advances toward the funnel and releases the ingredient into the funnel for expulsion therefrom.

Figure 7C:
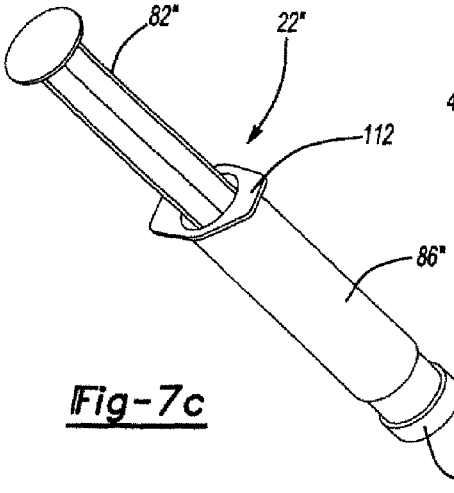
FIG. 7*c* is an exploded perspective view of another syringe assembly useful in the present invention.

Turning to FIG. 7*c*, another alternate ingredients container includes a plunger 82", a barrel 86" and optionally a cap 88". Preferably the barrel terminates in a luer tip of like structure as that of the tip 84 in FIG. 7*a* (though it is is optionally integrally formed with the barrel). Like with the container of FIG. 7*a* a suitable cap is employed such as available from Courtaulds Aerospace, Inc, under the trade name Semco. A preferred assembly is also described in U.S. Pat. No. 5,531,710, hereby incorporated by reference. The barrel preferably is configured to include a lip 112, flange or other like structure, which is adapted to help hold the container in place within one of the container holders 42' dispersed about a translatable carrier 24', as in FIGS. 13 and 13A. For example, the container holders 42' may include an undercut 113 into which the lip 112 is slid to help secure the container in place.

Figures 4, 5:
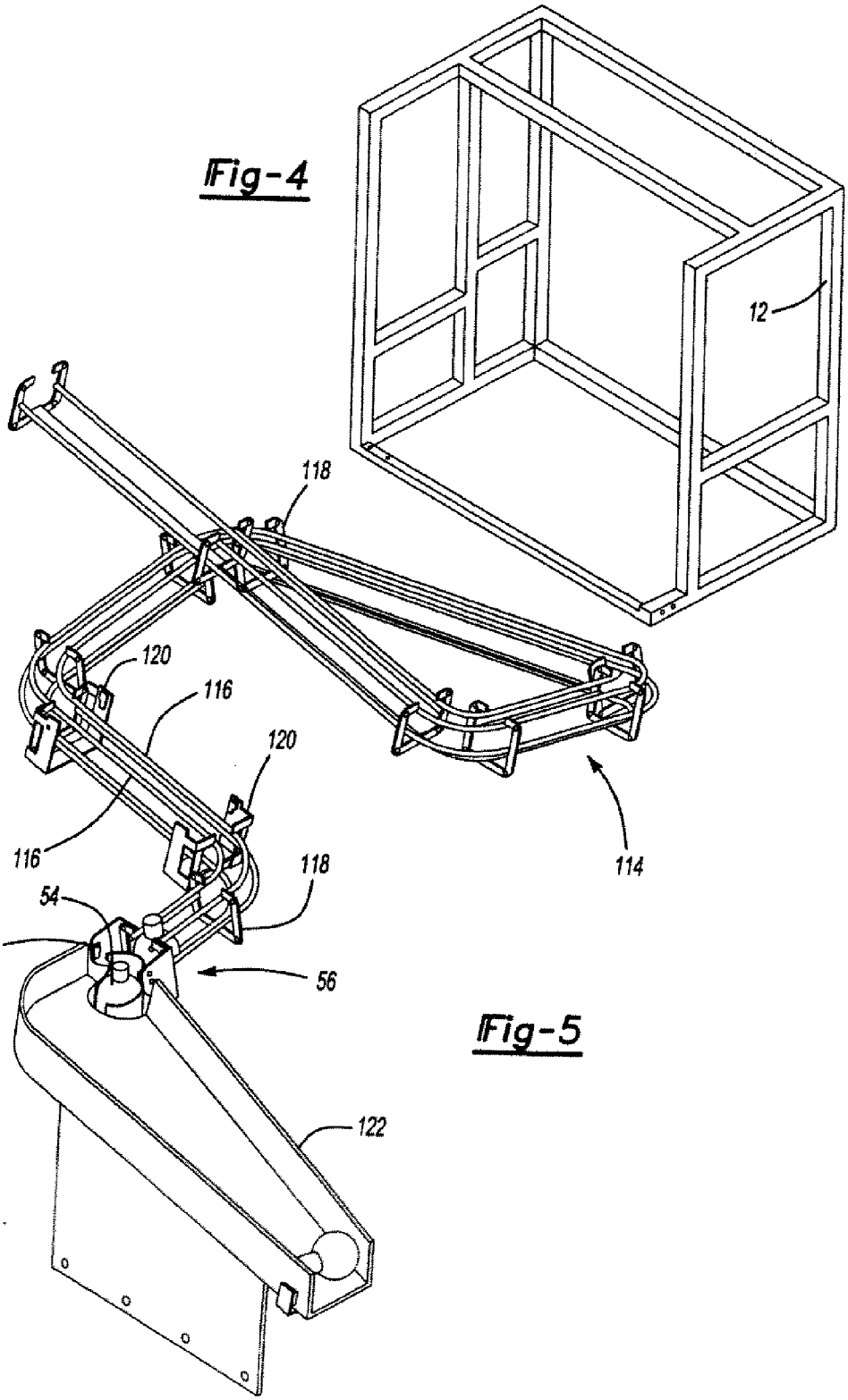
FIG. 4 is a perspective view of one illustrative frame of a housing in accordance with the present invention.
FIG. 5 is a perspective view of an illustrative track in accordance with the present invention.

Returning again to FIGS. 2 and 5, another aspect of the present invention involves a package delivery system within or from the apparatus of the present invention. Package delivery herein contemplates one or more of the delivery of an unfilled package for storing the resulting product to the dispensing site, the delivery of an at least partially-filled package from one site within the apparatus to another site, or even the delivery from a site within the apparatus to a site accessible to the operator of the apparatus. One optional feature of a preferred package delivery system of the present invention preferably includes a track system 114 for directing an empty package or a partially filled package from an operator loading site or a storage site, such as a shelf, rack or the like, to the dispensing site 56. The track system may be automated, such as one including a conveyor belt, a towing line or the like. More preferably, as seen in FIGS. 3 and 5, it is a track of spaced apart rails 116 that are arranged on an incline, and may be connected with a suitable connector or harness 118. Of course, it is also possible to form such a structure with cutouts from a single material, or by molding or otherwise forming a rail structure on an underlying substrate.

For this embodiment, as seen in 1, 2, 5, 9 and 10, a preferred package 82 preferably has a rounded outer surface (e.g., having a substantially to hemispherical, egg-shaped, pear-shaped, cylindrical or other rounded portion) that can rest on and roll or slide along the rails, such as under the force of gravity. A ramp 122 may also be included. For example, in FIGS. 1, 1*a*, 2, 3 and 5, the ramp located immediately downstream from the dispensing site 56 and the rails 116 are located immediately upstream.

Figure 10:
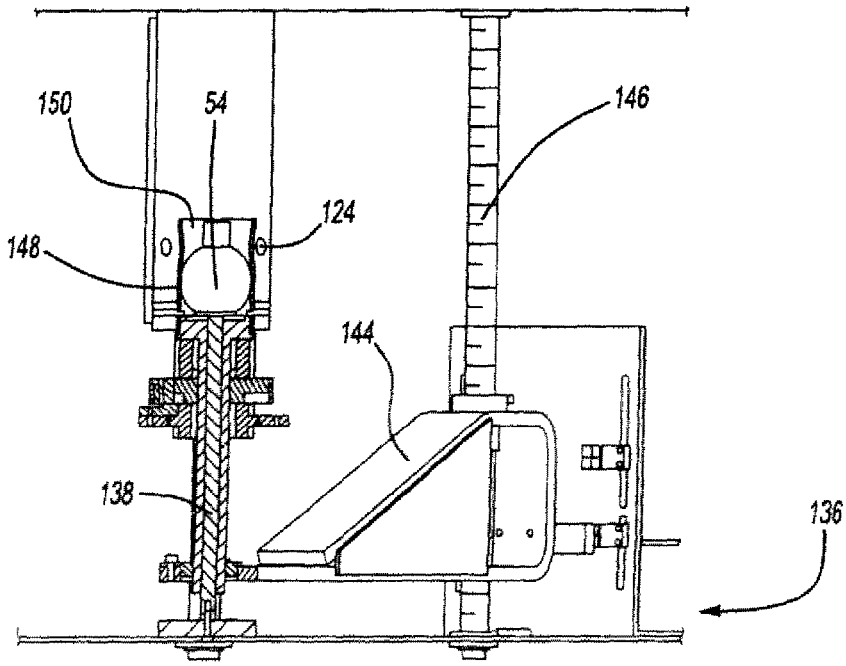
FIG. 10 is a sectional view through lines 10-10 of FIG. 9.

One or a plurality of sensors 120 (see FIG. 5), which may also be in signaling communication with the computer system or which may signal an audible or visual display, may be employed for monitoring the position or presence of packages along the track system. For example, as in FIG. 5, sensors 120 may be positioned along the track at two or more longitudinally spaced locations known to correspond with the presence of an established number of packages (e.g., at the 5 package location, the 10 package location or otherwise) upstream of the dispensing site. As seen in FIGS. 5 and 10, one or more sensors 124 (which likewise may also be in signaling communication with the computer system or which may signal an audible or visual display) may also be employed at the dispensing site to assure that a package is properly positioned before sensing.

Also shown in FIGS. 1-3, is an enclosed or open platform 126 (which itself optionally may function as a mixer, shaker or the like, or be connected to a device that does), into which filled packages may be deposited after dispensing. The platform 126 thus may include or be attached to a suitable oscillator, vibrator or other mixer device for helping to mix the contents of the package.

FIG. 3 also depicts an optional feature of one preferred embodiment pursuant to which the apparatus of the present invention is adapted for transport and delivery of filled or unfilled package within the apparatus such as for delivering a filled package to a delivery site 128. Pursuant to this embodiment the optional delivery system includes at least one platform 126, which is translatable within the machine from the dispensing site 56, or more preferably from the ramp 122 to a remote location, such as the delivery site.

In the embodiment shown, for example, a filled package 54 is preferably relocated from the dispensing site 56 to the platform 126, via the ramp 122. The to package 54 may be subjected to mixing during this relocation (e.g. before or along the ramp) or after arrival at the platform 126. For instance, in one embodiment, the platform 126 is vibrated, rotated or otherwise agitated for mixing the contents of the package 54.

Dispensing or mixing of ingredients is not limited by the above discussion. These steps may be accomplished using any of a number of different approaches other than previously described. A suitable heater or other device for controlling the temperature of the ingredients during dispensing, or for controlling the temperature of the package into which ingredients are dispensed. In this manner, selective control over the viscosity of ingredients during dispensing may be achieved, such temperature control device (e.g., a resistance heater, a halogen light bulb or other suitable energy source) can be placed proximate the ingredients containers, the packages into which ingredients are dispensed, or both. It may also be possible that the package is brought into contact with a mixing device that includes a suitable ultrasonic mixer. It may also be possible to employ a suitable thermal jacket or other suitable heat exchanger about a package into which ingredients are dispensed for locally heating the ingredients to reduce viscosity. A cooling jacket or other suitable heat exchanger may also be used as desired for cooling the package, ingredients therein, or even components of the apparatus (e.g., an ultrasonic device).

Preferably the platform 126 is translated from a first location to a remote location, in order to effectuate delivery of a filled package to an operator, such as a technician or end user. For example, though a conveyor may be employed or horizontal, diagonal or other translation, a preferred approach is to employ an elevator to raise or lower the platform 126. Referring again to FIG. 3, there is shown one such example, in which a motor 130 advances the platform 126. For example, the motor 130 may drive the platform 126 along a threaded shaft 132 that is threadingly engaged with the platform 126, for raising or lowering the platform in response to rotation of the shaft.

Upon reaching the desired remote location, the package is made available to the user. For the embodiment of FIGS. 1 and 3, for example, the platform 126 is elevated to be substantially juxtaposed with a delivery chute 134, to which the its package is released, e.g. to the delivery site 128, such as one having a cushioned surface, or one with or without a closure panel.

Figure 9:
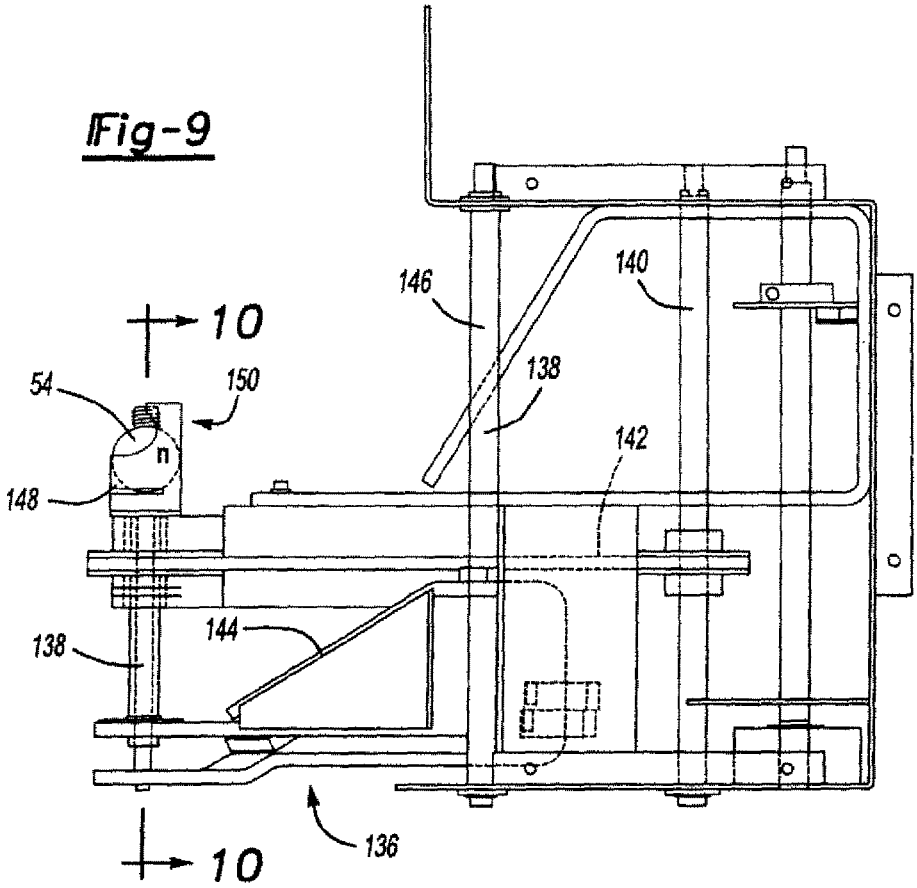
FIG. 9 is a side view of one type of an elevator mechanism in accordance with the present invention.

It will be appreciated that for automated systems that employed a package delivery system, it is also preferably to include a package lid device, for attaching, removing, or both, a lid from the package. Turning now to FIGS. 1-3 and 9-11, there is seen one such embodiment, in which the lid device 136 includes a spindle 138 and a drive shaft 140 that can be motor driven, such as via a belt 142 or other suitable driver, for rotating the spindle. The spindle 138 is rotatably mounted relative to a bracket assembly of suitable configuration. One preferred approach is to employ one or more lift brackets 144, which are connected to the spindle (e.g., threaded or otherwise connected) for vertical translation (e.g., by the lift bracket 144 being elevated along a shaft 146). Temporarily or permanently associated with the spindle (e.g., mounted to or integrally formed therewith, such as at an end) is a receptacle 148 for receiving the package 54 in a capped or uncapped state. The receptacle 148 may be any suitable configuration, but is preferably adapted for holding and holds the package in a fixed position during any capping operation. One such structure may include a hollow cylinder, ring or other generally surrounding structure, having a gripping surface defined on an interior wall, such as by a rubberized surface, an O-ring or the like. As depicted in the embodiment of FIGS. 9 and 10, for instance, the receptacle 148 is an elongated slit cylindrical structure made of an elastically deformable material, such as rolled 1095 Blue Clock spring steel (optionally suitably heat treated) so that the receptacle functions as a spring for gripping the outer surface of the package. As seen in FIG. 9, the receptacle may include a wall surface that has an elongated portion 150. In the above manner, rotation of the drive shaft 140 is translated into rotation of the spindle and any package held therein. As discussed previously, one or more sensors 124 may also be employed for detecting the presence, position or both of a package within the receptacle 148.

Figure 11:
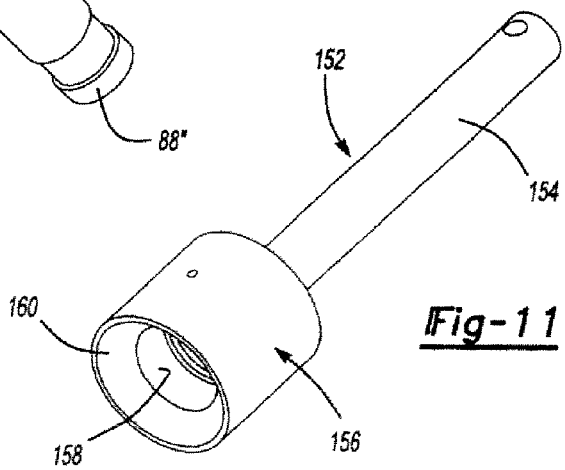
FIG. 11 is a perspective view of an illustrative chuck for package lidding or de-lidding in accordance with the present invention.

For the package closure operation, referring also to FIGS. 1, 3 and 11, a chuck 152 is brought into engagement with a closure, which is either attached to the translatable carrier structure 24 (e.g., attached about the circumference of the wheel 26 similar to an ingredients container 22). The chuck 152 (which may have an elongated shank 154) has a head portion 156 suitably configured with an interior wall portion 158 that preferably conforms generally with the shape of any closure, and may contain a suitable gripping surface, such as by a rubberized surface, an O-ring or the like. A chamfered surface 160 may be included to help facilitate location of the chuck relative to the closure. The chuck is preferably a rigid structure (e.g., it is made of metal such as type 304 stainless steel) and is preferably held static during the package closure operation. Of course, it may be rotatably driven as well in the opposite direction as the spindle. In one highly preferred embodiment, the chuck is carded on the translatable carrier 24, as shown in FIGS. 1 and 3. During closure operations, the translatable carrier is translated to bring the chuck into alignment with a closure of a package and the chuck, the package or both are rotated. The rotation will result in closing or opening of the package. After closure operations are completed, the package can then be advanced to the platform 126, such as by partial rotation of the receptacle 54 toward the ramp accompanied by contact with the actuator arm 80, and optionally elevation of the package by the lift bracket 144.

Figure 14:
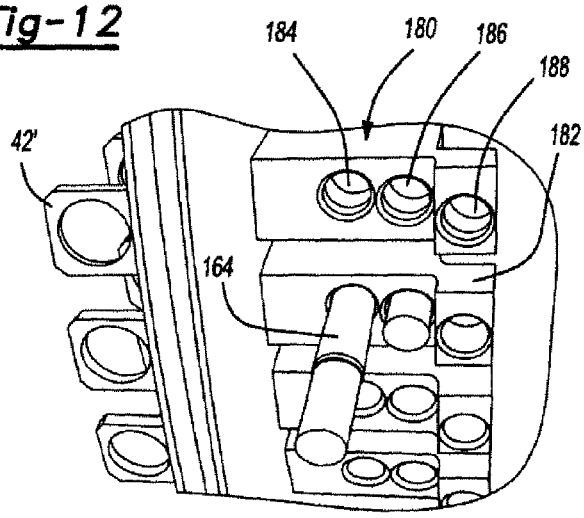
FIG. 14 is an enlarged sectional perspective view of a portion of the wheel assembly of FIG. 13.
Figure 13:
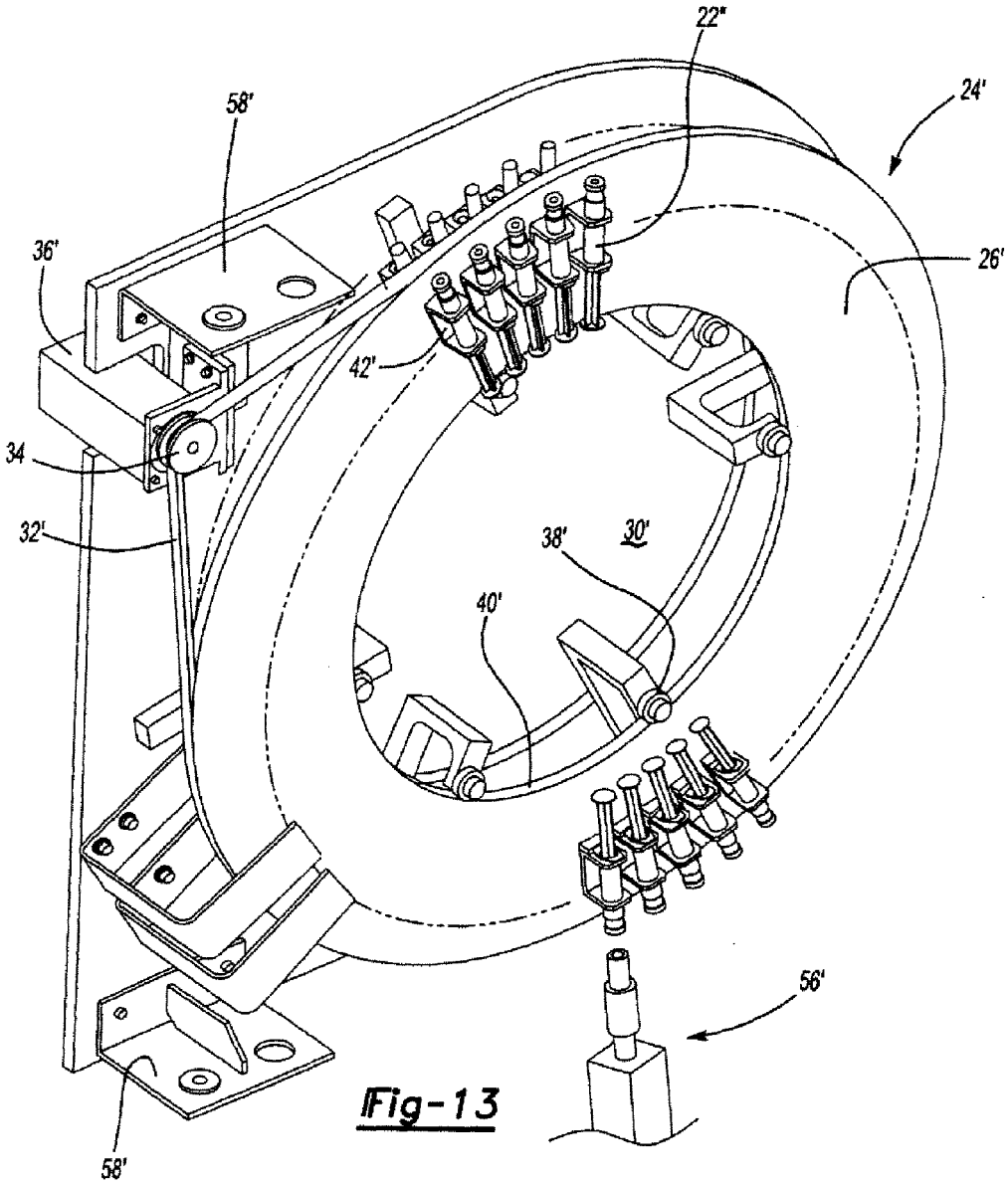
FIG. 13 is a perspective view of an alternative wheel assembly for holding ingredients containers in accordance with the present invention.
Figure 13A:
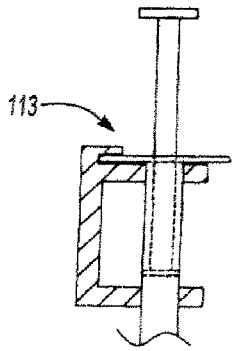
FIG. 13A is a side sectional view illustrating a manner of holding an ingredients container.

Though employing similar operation as described in the above embodiments, an alternative translatable carrier structure 24' is illustrated in FIGS. 13 and 14 (with like parts relative to the embodiment of FIG. 1 being denoted by like reference numerals). Like the structure of FIG. 1, it includes a belt driven wheel 26', which is pivotally connected by hinges 58' or the like at one end thereof. As in FIG. 1, rollers 38' help maintain a stable wheel position as it is rotated. In this embodiment, it is contemplated that packages or components thereof are loaded onto and carried by the wheel.

In this alternative structure, the ingredients containers may be of any of the above types, with a preferred structure being the type illustrated in FIG. 7*c*. Likewise, though dispensing may be performed into any suitable container or package a preferred package for this embodiment is as described hereafter in connection with a brush pen applicator package 162, such as is shown in FIG. 15.

Pursuant to this embodiment of FIG. 13, a holder 164 is provided at the dispensing site 56' for receiving a package into which the ingredients are to dispensed. An actuator such as is employed in FIG. 1 and shown in FIG. 6 may be employed for depressing the plunger 82" of the ingredients container 22". Likewise, the capping mechanism (not shown) described previously in the embodiments of FIGS. 1 and 3 may be used for removing and replacing caps of the ingredients containers.

Figure 15:
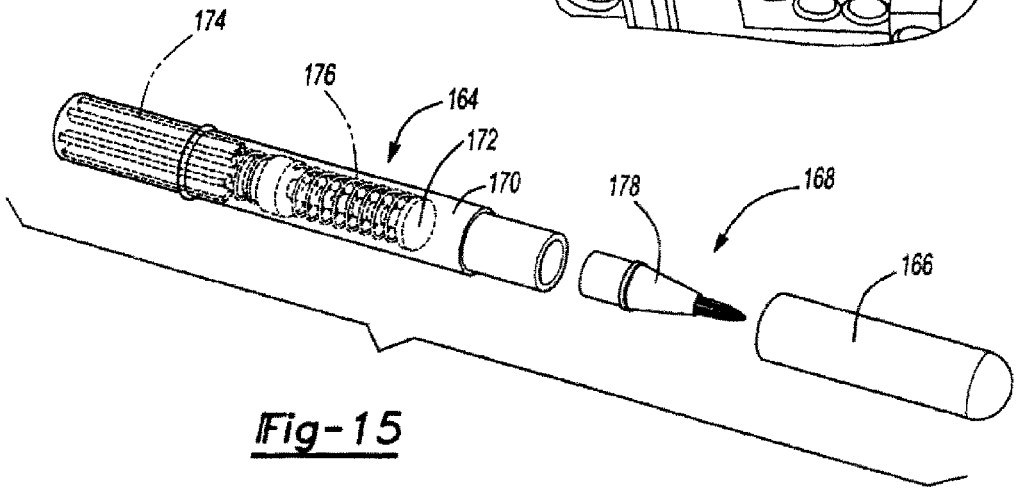
FIG. 15 is an exploded perspective view of one of the illustrative cosmetic packages in accordance with the present invention.

Referring to FIGS. 14 and 15, there is depicted another alternative illustrative applicator package 162 in accordance with the present invention, particularly one that is adapted for applying a facial cosmetic, such as a lip or eye cosmetic (e.g. a lip gloss).

The package 162 includes a container portion 164 (which optionally is at least partially transparent for viewing of contents) for receiving and storing a cosmetic formulation, a closure 166, and an optional applicator portion 168. Though functions may be integrated into fewer components or split into more components, preferably the package 162 includes the container portion 164, closure 166 and applicator portion 168 as separate components.

A preferred container portion 164 includes a suitable barrel 170 for receiving the formulation. It may optionally include a plunger 172, being advanceable such as by a twistable end plug 174 that can be rotated to advance the internal plunger gradually or in increments (such as by an indexing advance mechanism). One or a plurality of springs 176 may be employed for helping to advance the plunger. A rotatable spring, paddle, blade, or the like may also be included within the barrel ahead of the plunger (e.g. optionally attached to a screw on tip, so that mixing can take place at the same time the tip is applied) for scraping side walls of the barrel or for mixing ingredients of the formulation.

The applicator is shown to include a tip 178 and particularly a brush tip. However, a sponge, swab, felt tip or other suitable tip may be used. The tip 178 preferably is in fluid communication with the contents held in the container portion. Any suitable cap may be used as a closure. It may be a snap fit, a friction fit, a threaded cap for twist-off removal. It may also include a suitable art-disclosed locking mechanism (e.g. a "child lock"). An example of one type of package that may be employed or modified in accordance with the teachings herein is available commercially from Cosmopak Corp., as a Flow Through Brush Pen (Ref 2-013-O).

Other suitable packages may also be adapted for employment herein including the applicators described in commonly owned U.S. Pat. No. 6,412,658. It is also contemplated that the package may be such, or the operation of the apparatus herein is such, that two or more ingredients may be simultaneously or consecutively dispensed into the same package to create a swirl visual effect, a layered visual effect or some other desired visual effect.

Examples of other applicators commercially include pump barrel applicators for advancing contents with a pump or a depressible plunger, dual-end applicators that permit for dispensing application of different materials at different ends of the applicator, other brush pen applicators than the above preferred applicator, as well as applicators of the type disclosed in U.S. Pat. Nos. 6,371,129; 6,270,273; 6,186,686; 5,716,150; 4,764,044, or the like; all of which are hereby expressly incorporated by reference for all purposes herein.

As seen in FIG. 14, in the practice of one preferred aspect of the present invention, the components of a package as described in FIG. 15 are kept separate until substantially the time of dispensing, when they are assembled. In this regard, the wheel 26' includes thereon a storage structure 180 for the respective components. For example, seen in FIG. 14, the housing includes a flange 182 that has radial bores therein for receiving and holding the components. Thus, a first bore 184 may receive the container portion 164, a second bore 186 may receive the applicator portion 168, and a third bore 188 may receive the closure 166 (not shown in FIG. 14).

In the course of dispensing, the container portion 164 is removed from its bore and held in place by a holder 190 at the dispensing site 56', as seen in FIG. 13. The formulation is dispensed into the container portion and then the respective applicator for that package is brought into alignment with the container portion (e.g., using a mechanism such as illustrated in FIG. 12), and it is press fit snap fit, twisted or otherwise attached in place to the container portion. Thereafter the cap is placed on the assembly.

It may also be possible that the closure and applicator portion are integrated into a single unit for purposes of assembly or even permanently (e.g. wherein the closure would be hingedly connected to the applicator). Thus, it is also possible that the steps of assembling the closure and applicator portion may be combined into a single step. Likewise it may also be possible that the is container portion, the applicator portion and the closure comprise one or more assemblies and access to the container portion is provided by a port or other opening, which itself may be sealable.

As with all of the motor driven components disclosed herein, the spindle, chuck, or both may be driven manually, but preferably it is motor driven, by the same motor as one of the other motor driven components of the apparatus, or by its own motor.

Operation of the invention herein is demonstrated by discussion of automated systems. The system, however, can be manually operated, such as by omission of a computer, software, or omission of one or more motors. The use of motors has been described throughout the specification. It should be appreciated that the selection of a particular motor may be application dependent. Nevertheless, any suitable motor may be employed and selected from AC motors, DC motors, servo motors, stepper motors or combinations thereof. By way of example, Table I identifies a variety of different motors and illustrations of their possible usage. VEXTA Brand Motors are available commercially from Oriental Motor Co.

TABLE I

| Motor | Purpose |
|---|---|
| OM-PRS63463 OLF20N-1 Linear head AC Motor | Capper motor 96 |
| VEXTA Gear Head GFH2G5 | Elevator Motor 130, Bell Crank 64 |
| VEXTA AXHM230KC-GFH | Shaker for platform 126 |
| VEXTA ASM66AK-T10 | Wheel Belt 32/32' |
| VEXTA ASM36AK | Actuator 66 |

Motors may be coupled for linear, rotational or other translation of components in any suitable manner either by direct attachment, or indirect attachment, such as by using any suitable transmission lines or other linkage. As discussed, for example, a motor may drive a rotary shaft for operating a pulley to drive a belt. A motor may employed a threaded drive shaft. A motor may drive a plunger, piston or the like.

The motors employed may be such that they drive an object at a constant speed, at different speeds, under acceleration, under deceleration or a combination thereof. For example, it is possible that a motor may be employed to drive an object a length of X mm. The length X may consist of two or more smaller lengths (e.g., Y and X−Y, so that Y (X−Y)=X). The motor may be advanced at a faster rate for part of the length (e.g., Y) but at a slower rate for the remaining part. In this manner it is possible to increase dispensing efficiency by reducing the time spent on rate determining steps involving motor driving.

Automation of the mechanisms of the present invention may be further facilitated by the employment of one or a plurality of sensors. For example, sensors may be employed for initializing the wheels. For example, sensors may be mounted on one or a plurality of arms 192 that detect the presence of a marker on the wheel, such as the presence of an irregular pattern (shown as a first and second radially disposed apertures 194 and 196 in FIGS. 1 and 3). The sensor may alternatively be placed on the wheel itself and it will seek a marker affixed elsewhere in the machine. In this manner, the wheel will be rotated until the marker is detected at which point it is returned to its proper initial position.

As discussed, sensors may be employed for detecting the presence of a package, such as the number of packages present along the track 114. For example, as in FIG. 5 sensors may be positioned along the track at two or more longitudinally spaced locations known to correspond with the presence of an established number of packages. (e.g. at the 5 package location, the 10 package location or otherwise). A sensor may also be employed at the dispensing site to assure that a package is properly positioned before sensing. Sensors may be employed elsewhere such as for detecting positions or the presence of one or more other components such as the platform 126, a component of the capper mechanism 90, or any other part that moves within the apparatus of the present invention.

The type of sensor employed is not critical. They may be selected from among the various art-disclosed sensors such as proximity sensors, photoelectric sensors, linear displacement sensors, or the like. They may be front sensors, side sensors or a combination thereof. The sensors may be wired to a computer, wired to a controller, or may be wireless. Examples of commercially available sensors suitable for use herein include those available commercially from Matsushita Electric Works AG under the brands NAIS or SUNX.

In another embodiment, it may be desirable to handle a package for insertion into the apparatus of the present invention by placing it into the apparatus through a door or into a drawer for processing. For example, the package can be inserted into a drawer, e.g., a horizontally slidable drawer, that can be locked or otherwise secured during processing. Software may control the locking function (e.g., by signaling a solenoid or other suitable device) so that locking occurs automatically when the receptacle is inserted into the drawer.

The package may be otherwise held in place during operation of the present apparatus by a suitable holder, such as by use of the above described capping mechanism, a vacuum chuck or the like, during any cap removal, product dispensing, cap installation, and mix operations. The chuck may be mounted or otherwise driven by a motor that optionally provides simple rotation as well as additional agitation of the product by a dual-orbit motion or other motion for mixing.

User profiles, selections, formulations, and other inputted information provided to the computer 16 associated with the present apparatus can optionally be stored on a CD-R disk, a floppy disk, a memory stick, memory card or other suitable storage medium to allow transfer of user information from machine to machine, or between applications remote in time. In this manner, the user may be able to carry away information about the user's selection for later access.

Turning in more detail to FIG. 1*a*, the dispensing can be done in an enclosed chamber, such as behind one or more panels 14, e.g., a transparent glass or plastic panel over all or only a portion of it. Any panel 14 may also have a graphic thereon, or etched therein. In one preferred embodiment, at least one panel 14 is detachably or hingedly mounted to the frame 12.

The frame 12 (which may be any suitable configuration) may include a plurality of metal (e.g., aluminum) bars or sections that are joined together. The frame 12 may be any desired shape, and will be a matter of ornamental design choice. For example, in FIG. 4 it is depicted as having a plurality of orthogonally disposed straight bars. The bars, however, may be diagonally disposed, they may be curved, or otherwise.

One preferred chamber will be suitably vented for dispersing vapors to the atmosphere, and optionally may be equipped with suitable filters, scrubbers, clean air catalysts or the like for treating the vapors before dispersion to the atmosphere.

It is possible each of the reservoirs is part of its own independent syringe, or that it merely comprises the barrel portion of a syringe, and is brought together during operation with a plunger. Thus the actuator might have a plunger associated with it for performing this function.

A preferred composition, the ingredients of which are dispensed in accordance with the present invention is one that is suitable for providing a nail polish. In one embodiment the ingredients that are dispensed in accordance with the present invention are nitrocellulose based materials. However, the invention is not limited to the dispensing of such material. Dispensing of one or more other materials (such as for use as a base material into which other ingredients are dispensed) is also possible, such as without limitation, acrylic based materials. The material may be provided as a water based materials, or in an organic solvent. The nail polish may include a combination of materials as a primary film forming material, such as a nitrocellulose, acrylics (e.g., methacrylate polymers), vinyl polymers or the like. In addition to one or more pigments, organic colorants or inorganic colorants, any of a number of additives may also be employed, such as an ingredient selected from art-disclosed nail strengtheners, nail conditioners, fungicides, vitamins (e.g., vitamin A, B, C, E or otherwise), ultra-violet absorber, fragrance, micro-fibers, or fillers, suspending agents, plasticizers, secondary film forming resins (e.g., an aldehyde, a sulfonamide, a polyamide, a (meth)acrylate, an alkyd, a vinyl or the like). Suitable ingredients may be employed so that the apparatus of the present invention dispenses a formulation may vary depending upon the selection by the user of, for example, clear, pastel, sheer, true color, steel, iridescent, metallic, glow in the dark, glossy, semi-glossy, matte or otherwise.

It will this be appreciated that the present invention is also applicable to the selection and preparation of cosmetics or personal care items other than nail polish (such as, lip gloss, eye gel, cheek gel, creams, lotions, perfumes, body powders or the like).

The materials used to build a dispensing apparatus in accordance with the present invention are not critical. They may be metal, plastic, ceramic, composite, or a combination thereof. The may be coated or uncoated. In particular, the surfaces that are expected to contact the packages in the operation of the present invention may be bare or they may be treated intermittently or entirely over all or a portion of them. For example it is possible that the surfaces are coated with a paint, a plastic film, a foam, an elastomeric pad, a low friction surface (e.g. from a fluorocarbon such a PTFE, a polyolefin such as a high or ultra high molecular weight polyethylene or blends including the same or otherwise) or some other functional or protective surface for resisting the effect of chemicals, environment, temperature, light, for absorbing energy, for insulation, or otherwise.

The present invention may be employed in accordance with the teachings of commonly-owned applications NAIL COLOR POLISH SELECTION SYSTEM AND METHOD (Continuation of Ser. No. 09/818,389 (filed Mar. 27, 2001)), and NAIL COLOR POLISH SELECTION SYSTEM AND METHOD (Ser. No. 09/872,929 (filed Jun. 1, 2001)), which are hereby expressly incorporated by reference. Accordingly, in one preferred embodiment, the apparatus of the present invention is employed in a method comprising the steps of:

a) providing, at a retail point of sale, a plurality of ingredients dispensing containers containing different liquid cosmetic ingredients and being translatably (and preferably radially) disposed about an axis for dispensing ingredients of a custom cosmetic formulation;
b) actuating one or more of the dispensing containers for dispensing a first cosmetic formulation into a first package; and
c) actuating one or more of said syringes for dispensing a second custom cosmetic formulations, different from the first formulation, into a second package.

The method and apparatus of the present invention may be employed in a pod or other display assembly. A user interface may be provided for permitting a user to input information about a selection to a computer, which will operate the instrument. Other ways to use the apparatus of the present invention can be further gleaned from commonly-owned applications NAIL COLOR POLISH SELECTION SYSTEM AND METHOD (Continuation of Ser. No. 09/818,389 (filed Mar. 27, 2001)), and NAIL COLOR POLISH SELECTION SYSTEM AND METHOD (Ser. No. 09/872,929 (filed Jun. 1, 2001)), which are hereby expressly incorporated by reference. It is also possible that the present apparatus is operated to dispense a liquid cosmetic at a retail point of sale, and also at that location a custom body powder is dispensed, a custom temporary tattoo is delivered, both lip gloss and nail polish is dispensed, or a combination of the foregoing. An example of one such powder dispensing apparatus is disclosed in commonly owned U.S. Pat. No. 6,412,658, hereby incorporated by reference for all purposes. Art-disclosed techniques for temporary tattoos may be employed, such as disclosed in U.S. Pat. No. 6,264,786 (Cromett), hereby incorporated by reference for all purposes.

In connection with the automation of the apparatus of the present invention, it is contemplated that software is employed that includes the functions of providing a user interface, instructing the apparatus to dispense a solid or liquid in predetermined proportions or a combination thereof. The software also preferably functions for storing information about users for subsequent retrieval, storing information about recipes for a cosmetic formulation or a combination thereof. In one embodiment, the software is also adapted for enabling a user to perform queries for accumulating information about user preferences, inventory or the like.

The software of the present invention is particularly useful in a cosmetic dispensing station (e.g., as a pod or other display assembly) that includes a computer system that has associated therewith plug-in hardware components, such as a component selected from the group consisting of an optional input device (e.g., a CD player card reader, barcode scanner, DVD reader, CD writer, a Radio-Frequency Identification (RFID) system or the like), an output display device, a spectrophotometer (optional), a dispenser, and combinations thereof.

It will be appreciated from the above that an RFID system that is employed by a user would employ a small transponder or like device that communicates with the apparatus of the present invention, such as through a reader device. For example, the reader device, which interfaces also with the apparatus, transmits signals with the transponder. The transponder will have a unique identification code that corresponds with and affords access to a card account in a host database for the particular user. Other user interfaces may also be employed (such as one or more including a viewing screen, touch screen, barcode scanner, light pen, voice recognition, keyboard, tracking ball, mouse or the like).

The system may be employed as an individual station or may be optionally networked with other stations or computers, e.g., via a web server. The system of the present invention may include other components, such as suitable storage media, computer hardware, packaging labels (e.g., the software may command a printer to print a label for a particular user based upon the user's selection, etc.). Any suitable information storage medium may be employed by a user, such as a CD, DVD, diskette, memory card, chip, transponder or some other medium that is transportable, allowing a user to carry information about a cosmetic selection away from the station for later retrieval. It will also be appreciated that a user may be able to choose a particular selection from a plurality of predetermined formulations from which the user may make a selection (e.g., via a palette on an output display having a recipe that corresponds with a particular color); by providing a spectrophotometer for analyzing a color choice presented by the user (e.g., at the point-of-sale); in which case the spectrophotometer will identify the color and match it with a corresponding color stored in a database, and from which a color recipe is also stored or can be derived; providing a standardized color chart; or a combination thereof.

The present invention may be used in combination with other art-disclosed technology. For example, U.S. Pat. No. 6,338,030 (Senn et al) discloses a is system employing a spectrophotometer that may be adapted for the present invention, and is hereby expressly incorporated by reference herein. See also, U.S. Pat. No. 5,267,178 (Berner), U.S. Pat. No. 5,982,501 (Benz et al), hereby expressly incorporated by reference herein.

The present invention advantageously allows for the rapid selection customization and dispensing of cosmetics (particularly nail polish) for different individual retail customers in a matter of less than about one hour, and more preferably less than about 30 minutes, and more preferably less than about 15 minutes, and still more preferably less than about 5 minutes per selection.

It will be appreciated from the above that the invention may be employed to dispense more than two formulations into more than two containers and, thus, reference to "first" and "second" are not intended as limiting. In addition, it is possible that the apparatus and method of the present invention may be suitably modified to dispense simultaneously into two or more packages.

In this regard, the structure or operation of the present invention is not limited to solely the embodiments described. There are a number of variations that are contemplated as within the scope of the invention. For example, variations may be made for achieving a dispensing apparatus that allows plural ingredients containers to rapidly dispense into a package. A plurality of ingredients containers may be arranged on a common frame. For example, the containers are arranged with their longitudinal axes generally parallel to each other. The containers may be maintained in a fixed position or may be on a translatable structure. A package holder is provided and is fixed (e.g., if the containers are on a translatable structure) or translatable so that a package can be placed on the holder and the package and the container can be moved into dispensing alignment with each other. For example, the containers may be mounted on a frame and a track is situated below the containers, on which the package holder rides.

In other variations, without limitation, plural ingredients can be dispensed into one or more a plurality of packages simultaneously. Ingredients can be dispensed in fixed predetermined amounts (e.g., in a consistently metered is amount, such as may be desired for dispensing particulated material for a glitter effect) or predetermined amounts that vary form formulation to formulation. The invention may be operated for dispensing into one package while another filled package is being re-located to a delivery site, while an unfilled package is transported along the track, or a combination thereof.

It may also be possible to integrate onto a single wheel or other suitable carrier, ingredients for formulating a lip gloss and ingredients for formulating a nail polish. For example, a first side of the wheel may have nail polish ingredients and a second opposing side has lip gloss ingredients. A single side of the wheel may also integrate both lip gloss ingredients and nail polish ingredients. Of course, separation members or other separation techniques are preferably employed for maintaining certain ingredients separate when intermixing of such ingredients is undesirable, whereas, mixing techniques as described herein may be used for intermixing ingredients where such mixing is actually desired.

Unless stated otherwise, dimensions and geometries of the various structures depicted herein are not intended to be restrictive of the invention, and other dimensions or geometries are possible. Plural structural components, steps or the like can be provided by a single integrated structure, step or the like. Alternatively, a single integrated structure step might be divided into separate plural components or steps. However, it is also possible that the functions are integrated into a single device. In addition, it is possible to omit one or more of the disclosed components or the functions they perform.

For example, other highly preferred embodiments of the present invention contemplate a system such as is disclosed herein, but which omits any delivery mechanism or structure for transporting a package from the dispensing site to the package delivery site.

It is also possible that an apparatus in accordance with the present invention will omit a package lid device, a cap removal mechanism or both. In this regard, one embodiment contemplates supplying a package that does not include a lid at the time it arrives at the dispensing site, at the time it departs the dispensing site, or both. Package de-lidding (if employed by the apparatus of the present invention, manually or otherwise) may occur in an upstream operation, with lidding (if any) done in a downstream operation. A housing for the apparatus may also be omitted.

In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The present invention has been demonstrated herein with particular attention to its utility for dispensing ingredients for custom cosmetics formulations (specifically, liquid based cosmetics, such as nail polish or lip gloss). The invention is not limited strictly to these applications and it may find utility in other applications, such as the custom dispensing of food ingredients, personal care products ingredients (e.g., shampoos, hair dyes, conditioners, creams, ointments); pharmaceutical ingredients, beverage ingredients (e.g., for providing an automated bar tender), as well as many others.

As will be appreciated from the above, the present invention may be manually operated, but is preferably automated. To accomplish automation, a preferred approach is to have the computer system 16 of FIG. 1*b* suitably interfaced with the apparatus of the present invention. This may be done in any convenient manner and is not critical. By way of example, an interface such as an electrical back plane may be incorporated in (e.g., in the upper rear portion of the apparatus) or near the apparatus to which the respective motors or other power driven components of the apparatus are attached, with a suitable connection from the computer to the electrical back plane.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined is with reference to the appended claims, along with the full scope of equivalents to which such claims are entitled. The disclosures of all articles and references, including patent applications and publications, are incorporated by reference for all purposes.

What is claimed is:

1. A retail point-of-sale custom cosmetic formulation dispenser, comprising:

a) an ingredient carrier that is mounted for translation about at least one axis;

b) a plurality of containers each filled with a different ingredient for a custom cosmetic formulation;

c) a container holder positioned about the ingredient carrier that holds each of the plurality of containers to the ingredient carrier, and allows removal and replacement of containers;

d) an actuator for dispensing the ingredients from the containers;

e) at least one motor for translating the ingredient carrier about the at least one axis;

f) a platform extending from a first location to a remote location in order to effectuate delivery of a filled package to a technician or an end user; and g) a housing for substantially enclosing the plurality of containers and the ingredient carrier, and having a transparent panel to permit viewing of a dispensing step performed at the retail point of sale.

2. The apparatus of claim 1, wherein the actuator is adapted for dispensing one ingredient at a time from the containers.

3. The apparatus of claim 1, wherein the actuator includes a push rod that is slidingly mounted in a frame and has a free end for depressing a plunger in each of the plurality of ingredient containers.

4. The apparatus of claim 3, wherein the actuator further comprises at least one sensor for detecting a relative position of the push rod.

5. The apparatus of claim 1, wherein at least two of the containers include cellulose-based nail polish ingredients.

6. The apparatus of claim 2, wherein each of the plurality of containers is a syringe and each of the syringes include a plunger.

7. The apparatus of claim 2, wherein the actuator includes a plunger.

8. The apparatus of claim 2, further comprising a holder, including a chuck, for receiving and holding a package into which the custom cosmetic formulation is to be dispensed.

9. The apparatus of claim 1, wherein at least one of the plurality of containers includes particulated sparkle effect.

10. The apparatus of claim 9, wherein at least two of the plurality of containers include lip gloss ingredients.

11. The apparatus of claim 1, wherein the ingredient holder is a wheel.

12. The apparatus of claim 11, further comprising a capping device.

13. The apparatus of claim 12, wherein the platform includes a shaker mechanism.

14. The apparatus of claim 12, wherein a package into which the ingredients are dispensed has a rounded outer surface for permitting the package to roll along the platform.

15. The apparatus of claim 12, wherein the capping device is adapted for removing a cap, re-applying a cap, or both.

16. The apparatus of claim 12, wherein the capping device includes a cap holder having a gripping structure for removing a cap and holding the cap in place during filling of a package and re-applying the cap once the package is filled.

17. The apparatus of claim 12, wherein the capping device includes a base portion that carries a retractable cap holder and a motor that translates the holder along the base portion.

18. The apparatus of claim 12, wherein a dispensing site includes a sensor to assure that a package is properly positioned before filling of a package.

19. The apparatus of claim 12, wherein the custom cosmetic formulation is mixed during relocation on the platform.

20. The apparatus of claim 12, wherein the housing includes a mixing device that mixes the custom cosmetic formulation that is dispensed into a package.

* * * * *